US006458519B1

(12) United States Patent
Sampei

(10) Patent No.: US 6,458,519 B1
(45) Date of Patent: Oct. 1, 2002

(54) PHOTOTHERMOGRAPHIC MATERIAL AND IMAGE FORMING METHOD BY THE USE THEREOF

(75) Inventor: Takeshi Sampei, Hino (JP)

(73) Assignee: Konica Corporation (JP)

( * ) Notice: Subject to any disclaimer, the term of this patent is extended or adjusted under 35 U.S.C. 154(b) by 28 days.

(21) Appl. No.: 09/642,413

(22) Filed: Aug. 21, 2000

(30) Foreign Application Priority Data

Aug. 25, 1999 (JP) ..... 11-238293

(51) Int. Cl.[7] ..... G03C 1/498
(52) U.S. Cl. ..... 430/350; 430/531; 430/619
(58) Field of Search ..... 430/619, 617, 430/350, 531

(56) References Cited

U.S. PATENT DOCUMENTS 6,140,037 A * 10/2000 Katoh et al. ..... 430/619

6,248,512 B1 * 6/2001 Miura et al. ..... 430/619

* cited by examiner

*Primary Examiner*—Thorl Chea
(74) *Attorney, Agent, or Firm*—Bierman, Muserlian & Lucas

(57) ABSTRACT

A photothermographic material comprising a support, silver halide, an organic silver salt and a reducing agent is disclosed, meeting the following requirement:

$$-15<100\times(S_1-S_0)/S_0<15$$

wherein $S_0$ represents a sensitivity of the photothermographic material heat-developed after being allowed to stand at 23° C. and 50% Rh for a period of 3 days and $S_1$ represents a sensitivity of the photothermographic material heat-developed after being allowed to stand at 55° C. and 80% RH for a period of 3 days. An image forming process by the use of the photothermographic material is also disclosed.

16 Claims, 1 Drawing Sheet

PHOTOTHERMOGRAPHIC MATERIAL AND IMAGE FORMING METHOD BY THE USE THEREOF

FIELD OF THE INVENTION

The present invention relates to photothermographic materials exhibiting superior transport property in processing in an automatic processor, reduced fogging and improved stability in variation of processing conditions, and an image forming process by use thereof.

BACKGROUND OF THE INVENTION

In the field of printing plate-making and medical diagnosis, waste liquor produced in wet-processing of image forming material comes into problems and reduction of processing effluent is strongly desired in terms of environmental protection and space saving. Accordingly, a technique for photothermographic materials is required, which enables efficient exposure by means of a laser image setter or a laser imager and formation of black images exhibiting high resolution and clearness.

As such a technique is known a thermally developable photothermographic material which comprises on a support an organic silver salt, light sensitive silver halide grains, reducing agent and a binder, as described in U.S. Pat. Nos. 3,152,904 and 3,487,075, and D. Morgan "Dry Silver Photographic Materials" in Handbook of Imaging materials page 48 (Marcel Dekker Inc., 1991).

Photothermographic materials are usually processed by an automatic processor and processing at a temperature higher than 105° C. easily cause deformation of material, producing problems in transport. Specifically, problems arise in photothermographic materials in which polymeric latexes disclosed in JP-A 10-186568 are employed as a binder (hereinafter, the term, JP-A refers to an unexamined, published Japanese Patent Application). JP-A 9-297369 discloses a technique of a photothermographic material having a lowered Beck flatness. To achieve this, however, a relatively large amount of a large-sized matting agent need to be incorporated. Such a photothermographic material was inferior in haze, producing problems that the exposure time markedly increased at the time of printing onto a presensitized plate for use in plate-making and reproducibility of small dots was deteriorated, and therefore was not put into practical use.

Further, since photothermographic materials need not be subjected to a fixing treatment, there is a problem such as an aging increase of fog density. Another problem also arose such that photographic performance was deteriorated when the processing conditions were varied, specifically when the developing temperature was lowered. U.S. Pat. Nos. 5,545,515 and 5,545,505 disclose the use of a contrast-increasing agent in photothermographic materials. However, it was proved that the use of such a contrast-increasing agent resulted in deteriorated photographic performance when the developing temperature was lowered. JP-A 10-69023 teaches a photothermographic material containing a polymeric latex as binder, however, deterioration of photographic performance caused by a lowering of the developing temperature was not improved.

As can be seen from the foregoing, improvements in transport property, fogging after development and stability in variation of the processing conditions are desired in photothermographic materials.

SUMMARY OF THE INVENTION

It is an object of the present invention to provide a photothermographic material improved in transport property in processing in an automatic processor, fogging after being processed and stability in variation of processing conditions, and an image forming process by use thereof.

The object of the present invention can be accomplished by the following constitution:

1. A photothermographic material comprising a support, silver halide, an organic silver salt and a reducing agent, wherein the photothermographic material meets the following requirement:

$$-15<100\times(S_1-S_0)/S_0<15$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of a reciprocal of exposure giving a density of 2.5 obtained when the photothermographic material is exposed and heat-developed at 117° C. for 20 sec.;

2. The photothermographic material described in 1., wherein the photothermographic material comprises on the support component layers including an image forming layer, the image forming layer comprising the organic silver salt and the silver halide, and the image forming layer or a component layer adjacent to the image forming layer comprising the reducing agent;
3. The photothermographic material described in 2., wherein the image forming layer or a component layer adjacent to the image forming layer comprises a contrast-increasing agent;
4. The photothermographic material described in 1., wherein the photothermographic material exhibits an equilibrium moisture content of not more than 2% by weight;
5. The photothermographic material described in 2., wherein the uppermost layer of the image forming layer comprises a binder, the binder exhibiting an equilibrium moisture content of not more than 2% by weight;
6. The photothermographic material described in 2., wherein the photothermographic material exhibits a Vickers hardness of 40 to 150 on the image forming layer-side;
7. The photothermographic material described in 1., wherein the reducing agent is incorporated in the form of a solid particle dispersion;
8. The photothermographic material described in 1., wherein the photothermographic further comprises a tone modifier in the form of a solid particle dispersion;
9. The photothermographic material described in 1., wherein the silver halide is monodisperse grains;
10. The photothermographic material described in 1., wherein the organic silver salt is monodisperse grains having an average size of not more than 2 $\mu$m;
11. A method for processing a photothermographic material comprising:

subjecting the photothermographic material to heat-development, wherein the photothermographic material is subjected to heat-development at a temperature of 105 to 145° C.; and the photothermographic material comprises a support, silver halide, an organic silver salt and a reducing agent, and meeting the following requirement (1):

$$-15<100\times(S_1-S_0)/S_0<15 \qquad \text{requirement (1)}$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of reciprocal of exposure giving a density of 2.5 obtained when the photothermographic material is exposed and heat-developed at 117° C. for 20 sec.;

12. An exposure method of a photothermographic material comprising:

exposing the photothermographic material to light, wherein the photothermographic material comprises a support, silver halide, an organic silver salt and a reducing agent, and meeting the following requirement (1):

$$-15<100\times(S_1-S_0)/S_0<15 \quad \text{requirement (1)}$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of reciprocal of exposure giving a density of 2.5 obtained when the photothermographic material is exposed and heat-developed at 117° C. for 20 sec.;

13. The exposure method described in 12, wherein the photothermographic material is exposed to longitudinally multiple laser light;

14. The exposure method described in 13, wherein the laser light is not exposed at an angle substantially vertical to the exposed surface of the photothermographic material;

15. A photothermographic material comprising on a support, silver halide, an organic silver salt and a reducing agent. wherein the sensitivity of the photothermographic material meets the following requirement:

$$-15<100\times(S_1-S_0)/S_0<15$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of reciprocal of exposure giving a density of 2.5 obtained when the photothermographic material is exposed and heat-developed at 117° C. for 20 sec.;

16. The photothermographic material described in 15, wherein a component layer of the organic salt containing side contains a contrast-increasing agent;

17. An image forming method comprising:

subjecting the photothermographic material described in 15. or 16. at a temperature of 105 to 145° C.;

18. An image forming method comprising:

subjecting the photothermographic material described in 15. or 16. to exposure to longitudinally multiple laser light using an exposure apparatus; and 19. An image forming method comprising:

subjecting the photothermographic material described in 15. or 16. to exposure to laser light using an exposure apparatus, wherein the angle between the laser light and the exposed surface of the photothermographic material is not substantially a right angle.

DETAILED DESCRIPTION OF THE INVENTION

Figure 1:
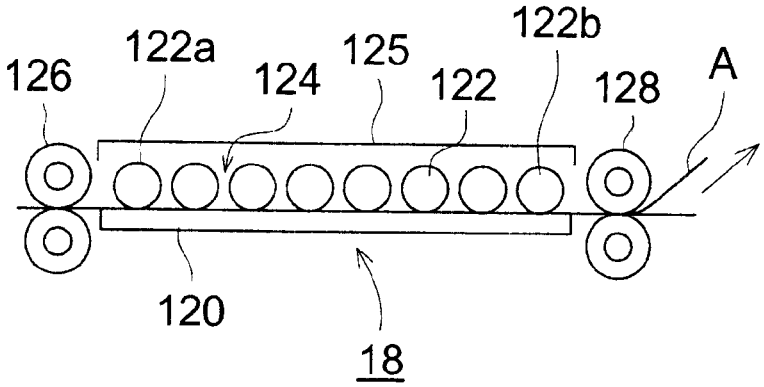
FIG. 1 illustrates a thermally processor used in this invention.

The photothermographic material according to this invention comprises a support, silver halide, an organic silver salt and a reducing agent, and meets the following requirement (1):

$$-15<100\times(S_1-S_0)/S_0<15 \quad \text{requirement (1)}$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of reciprocal of exposure giving a density of 2.5 obtained when the photothermographic material is exposed and heat-developed at 117° C. for 20 sec. The photothermographic material preferably comprises an image forming layer. The image forming layer contains organic silver salt grains, light sensitive silver halide grains and a binder. The photothermographic material preferably comprises a contrast-increasing agent and a tone modifier. The reducing agent, the contrast-increasing agent and the tone modifier are preferably contained in the image forming layer. The photothermographic material may further comprise one or more component layers other than the image forming layer. Examples, of the component layers include a sublayer, an antistatic layer, a protective layer, a cushion layer, anti-halation layer, and a backing layer. The reducing layer, contrast-increasing layer or tone modifier may be contained in a layer adjacent to the image forming layer. The photothermographic materials relating to this invention are exposed to light to form a latent image and thermally developed to form silver images.

Hereinafter, the formula, $100\times(S_1-S_0)/S_0$ in requirement (1) described above is denoted as sensitivity variation Sm. The requirement (1) can be achieved by the following means alone or in combination, and preferably by 1) through 6) or the combination thereof:

1) the equilibrium moisture content of the photothermographic material being not more than 2 wt %,
2) the binder of the uppermost layer of the image forming layer exhibiting an the equilibrium moisture content of not more than 2 wt %,
3) the binder of the uppermost layer of the image forming layer exhibiting a Vickers hardness of 40 to 150,
4) the reducing agent and the tone modifier each being incorporated in the form of a solid particle dispersion,
5) the silver halide grains being monodisperse grains, and
6) the organic silver salt grains having an average size of not more than 2 $\mu$m and being monodisoerse grains.

In this invention, the equilibrium moisture content of the photothermographic material (D) is defined as follows:

$$D\ (\%\ \text{by weight})=(w/W)\times 100$$

where W is the weight of a photothermographic material which has been in equilibrium under an atmosphere at 25° C. and 60% RH and w is the weight of moisture contained in the photothermographic material. The equilibrium moisture content at 25° C. and 60% RH is preferably 0.005 to 2% by weight, and more preferably 0.01 to 1% by weight.

The equilibrium moisture content can be determined according to the following procedure. After being allowed to stand in an atmosphere of 25° C. and 60% RH for 24 hrs., photothermographic material film was cut to a size of 46.3 $cm^2$. After weighing, it was shredded to ca. 5 mm pieces and put into a vial; and after sealing with septum and an aluminum cap, it was set into Head Space Sampler HP7694 (available from Hewlett Packard Corp.). After heating the Head Space Sampler at 120° C. for 20 min., the evaporated moisture was determined according to the Karl Fischer method.

An equilibrium moisture content of not more than 2% by weight can be achieved by coating by the use of an organic solvent in which solubility of water is 2% by weight or less. Examples of such organic solvents include benzene, toluene, xylene, hexane, cyclohexane, diethyl ether, diisopropyl ether, hydrofluoro-ether, methylene chloride, chloroform, and trichloroethylene. These solvents may be used alone or in combination. In combination with these solvents, a water-miscible solvent, as described below may be used within the range meeting the condition that the water content of the coating solution be not more than 2% by weight. Alternatively, an equilibrium moisture content of not more than 2% by weight can be achieved using the water-miscible solvent and a polymeric latex having an equilibrium moisture content of 0.01 to 2% by weight (and preferably 0.01 to 1% by weight). In this case, the definition and measurement of the equilibrium moisture content are referred to, for example, in "Kobunshi Kogaku Koza 14. Kobunshizairyo-Shikenho" (Series of Polymer Engineering, vol. 14, Testing method of Polymeric Material), edited by Kobunsh-Gakkai (published by Chijin-shoin). Alternatively, after coating and drying, the ophotothermographic material is to be stored in the form of a package covered with water-impermeable material and including a desiccating agent. Any desiccating agent which is capable of removing moisture is usable and preferred examples thereof include silica gel, molecular sieves, magnesium sulfate anhydride, sodium sulfate anhydride, pure iron and iron compounds. Of these, silica gel is preferred.

Reducing agents and tone modifiers used in this invention are incorporated preferably in the form of a solid particle dispersion. The solid particle dispersion can be prepared by commonly known vulcanizing means (e.g., ball mill, vibration ball mill, sand mill, colloid mill, jet mill, roller mill, etc.). In this case, dispersing aids may be employed. The reducing agent and tone modifier will also be described later. The tone modifier is contained preferably in an amount of $1\times10^{-3}$ to 2 mol/Ag mol, and more preferably $5\times10^{-3}$ to 1 mol/Ag mol.

It is preferred that the photothermographic material used in this invention has an image forming layer on one side of the support, and the uppermost layer of the image forming layer preferably exhibiting a Vickers hardness of 40 to 150. The Vickers hardness is defined as the hardness which can be determined according to the minute hardness testing method of JIS Z 2251. Thus, using a right pyramidal diamond indenter having a facing angle of 1300, the Vickers harness (Hv) is determined and defined as below:

Vickers hardness (Hv)=$1.8544\ F/d^2$ where F represents the load giving a hollow and d represents the average diagonal length of hollows. The measurement is made using a testing machine meeting JIS B 7734 (Minute hardness tester). Thus, in this invention, the measurement was made using tester MHA-400 (available from NEC Corp.) in an atmosphere of 23° C. and 50% RH. A photothermographic material having a support, as a specimen is indented while observing with scanning type electron microscope (SEM) and the Vickers harness is defined as a hardness at the time when the indenter reaches a depth of 50% of the thickness from the uppermost surface of the photothermographic material. The Vickers hardness within the range described above can be achieved by the use of a hydrophobic binder, a matting agent or a solid filler in the uppermost layer.

Preferred hydrophobic binders include, for example, polyvinyl butyral, cellulose acetate, cellulose acetate butylate, polyester and polymer latexes.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169. The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, more preferably of 1.0 to 8.0 $\mu$m, and still more preferably 1.0 to 5.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent used in this present invention can be incorporated into any layer. In order to accomplish the object of the present invention, the matting agent is preferably incorporated into the layer other than the photosensitive layer, and is more preferably incorporated into the farthest layer from the support. Addition methods of the matting agent include those in which a matting agent is previously dispersed into a coating composition and is then coated, and prior to the completion of drying, a matting agent is sprayed. When plural matting agents are added, both methods may be employed in combination. In cases where a non photosensitive layer is provided on the opposite side of the support to the photosensitive layer, it is preferred to incorporate a matting agent into at least one of the non-photosensitive layer (and more preferably, into the surface layer) in an amount of 0.5 to 40% by weight, based on the total binder on the opposite side to the photosensitive layer. There may be optionally used lubricants such as polysiloxane compounds and liquid paraffin.

Solid fillers include, for example, colloidal silica described in JP-A 55-126239 and 4-214551, colloidal montmorillonite clay, phosphates such as hydroxy-apatite, tabular silica such as smetite, inorganic materials such as zeolite and polymer particles exhibiting a glass transition point of 40° C. or more. Such solid fillers are preferably subjected to a surface treatment to enhance dispersing stability. Preferred examples of the surface treatment include coating of silane coupling agents and titanium coupling agents described in JP-A 4-257849. The colloidal silica has an average particle size of 0.005 to 1.0 μm (and preferably 0.005 to 0.5 μm) and is mainly comprised of silicon dioxide, and may contain alumina or sodium aluminate as a minor component. There is further contained inorganic bases as a stabulizer, such as sodium hydroxide, potassium hydroxide, lithium hydroxide, and ammonia. Exemplary examples of commercially available colloidal silica include Snowtex 30, Snowtex C, Snowtex O and Ludox AM which are available from Nissan Kagaku Co., Ltd. Tabular silica is a layered silicate containing alkali, alkaline earth metal and aluminum. Examples thereof include kaolin minerals such as kaolinite, dickite, nacrite, halloysite, and serpentine; mica clay minerals such as pyrophylite, tarc, white mica, swellable synthetic fluoromica, cericite, and chlorite;and smectites such as smectite, vermiculite, and swellable synthetic fluorvermiculite. Synthetic silica is preferred in terms of superior transparency, including, for example, Lucentite SWN or SWF available from Cope Chemical Co., Ltd. Specifically, it is preferred that at least 50% of the particle projected area is accounted for by tabular silica having not less than 2 of an aspect ratio (i.e., a ratio of equivalent circular diameter to a distance between two parallel planes. The thickness is preferably not more than 1.0 μm, and more preferably not more than 0.5 μm. Phosphates are inorganic compounds containing phosphoric acid as a constituent and its composites with an organic compounds. Examples thereof include apatite, nacicon, ammonium phosphate, calcium phosphate, cobalt phosphate, zirconium phosphate, sodium phosphate, magnesium phosphate, and silver phosphate. Of these is preferred apatite. Apatites include, for example, hydroxyapatite $Ca_{10}(PO_4)_6(OH)_2$, fluoroapatite $Ca_{10}(PO_4)_6F_2$, and chloroapatite $Ca_{10}(PO_4)_6Cl_2$, which may be any of minute one, porous one or composite one, and may also be any form of spherical, amorphous, needle-like or flake-like forms. Zeolite is an aluminum silicate, having a fundamental composition of $xM_2/nOAl_2O_3yH_2O$, based on $Al_2O_3$ and including natural products and synthetic products. Synthetic products are preferred in terms of less impurity. Examples of the natural product include analcite, erionite, modelnite, shabanitegmelinite and levynite; examples of the synthetic product include Zeolite A, Zeolite X, Zeolite Y, Zeolite L and synthetic modelnite; and these mat be any one of spherical, amorphous, needle-like, flake-like forms. Examples of commercially available apatite include 3A, 4A, 5A, AW-500, 10X, and 13x available from Toso Co., Ltd.; Molecular Sieve LINDER ZB-300, Sicalite available from Union Carbide Co.; and ZSM-5 available from Mobil Corp.

Solid filler is incorporated into a protective layer, so that finer one is more preferred, and the particle size is preferably not more than 1 μm, and more preferably not more than 0.1 μm. The amount to be incorporated is preferably not less than 0.01 g/m$^2$, and more preferably 0.05 to 1.0 g/m$^2$.

Light sensitive silver halide grain emulsions used in this invention can be prepared according to commonly known in the photographic art, such as single jet or double jet addition, and ammoniacal, neutral or acidic process. The silver halide grain emulsion prepared in advance is mixed with other ingredients used in this invention and the mixture is incorporated into the composition used in this invention. To allow the silver halide to bring into close contact with an organic silver salt, various means are applicable, including a technique of using polymers other than gelatin, such as polyvinyl acetals described in U.S. Pat. Nos. 3,706,564, 3,706,5653, 713,833 and 3,748,143, British Patent 1,362,970; a technique of enzymatic degradation of gelatin used in the silver halide emulsion, as described in British Patent 1,354,186; and a technique of preparing silver halide in the presence of a surfactant, without using a protective colloidal polymer.

Silver halide grains work-as a light sensor. In order to minimize cloudiness after image formation and to obtain excellent image quality, the less the average grain size, the more preferred, and the average grain size is preferably less than 0.1 μm, more preferably between 0.01 and 0.1 μm, and still more preferably between 0.02 and 0.08 μm. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a monodispersibility obtained by the formula described below of less than 40%; more preferably less than 30%, and most preferably from 0.1 to 25%.

Monodispersibility =(standard deviation of grain diameter)/(average grain diameter)×100(%)

The average silver halide grain size is preferably not more than 0.1 μm, and monodisperse grains are more preferred, thereby leading to enhanced graininess.

The silver halide grain shape is not specifically limited, including regular crystals such as cubic or octahedral grains and non-regular crystals such as spherical, bar-like or tabular grains. The halide composition of silver halide is not specifically limited, including silver chloride, silver chlorobromide, silver iodochlorobromide, silver bromide, silver iodobromide and silver iodide. The content of silver halide is preferably not more than 50%, more preferably 0.1 to 25%, and still more preferably 0.1 to 15%, based on organic silver salt.

Photosensitive silver halide used in the thermally developable photosensitive material of the invention can be formed simultaneously with the formation of organic silver salt by allowing a halide component such as a halide ion to concurrently be present together with organic silver salt-forming components and further introducing a silver ion thereinto during the course of preparing the organic silver salt.

Alternatively, a silver halide-forming component is allowed to act onto a pre-formed organic silver salt solution or dispersion or a sheet material containing an organic silver salt to convert a part of the organic silver salt to photosensitive silver halide. The thus formed silver halide is effectively in contact with the organic silver salt, exhibiting favorable actions. In this case, the silver halide-forming component refers to a compound capable of forming silver salt upon reaction with the organic silver salt. Such a compound can be distinguished by the following simple test. Thus, a compound to be tested is to be mixed with the organic silver salt, and if necessary, the presence of a peal specific to silver halide can be confirmed by the X-ray diffractometry, after heating. Compounds that have been confirmed to be effective as a silver halide-forming component include inorganic halide compounds, onium halides, halogenated hydrocarbons, N-halogenated compounds and other halogen containing compounds. These compounds are detailed in U.S. Pat. Nos. 4,009,039, 3,457,075 and 4,003, 749, British Patent 1,498,956 and JP-A 53-27027 and 53-25420. Exemplary examples thereof are shown below:

(1) Inorganic halide compound: e.g., a halide compound represented by formula, MXn, in which M represents H, NH4 or a metal atom; n is 1 when M is H or NH4 and a number equivalent to a valence number of the metal atom when M is the metal atom; the metal atom includes lithium, sodium, potassium, cesium, magnesium, calcium, strontium, barium, zinc, cadmium, mercury, tin, antimony, chromium, manganese, cobalt, rhodium, and cerium, and molecular halogen such as aqueous bromine being also effective;

(2) Onium halide: e.g., quaternary ammonium halides such as trimethylphenylammonium bromide, cetylethyldimethylammonium bromide, and trimethylbenzylammonium bromide; and tertiary sulfonium halides such as trimethylsulfonium iodide;

(3) Halogenated hydrocarbons: e.g., iodoform, bromoform, carbon tetrachloride and 2-brom-2-methylpropane;

(4) N-halogeno compounds: e.g., N-chlorosuccinimide, N-bromosucciimde, N-bromophthalimide, N-bromoacetoamide, N-iodosuccinimide, N-bromophthalazinone, N-bromooxazolinone, N-chlorophthalazinone, N-bromoacetoanilide, N,N-dibromobenzenesulfonamide, N-bromo-N-methylbenzenesulfonamide, 1,3-dibromo-4,4-dimethylhydantoin and N-bromourazole;

(5) Other halogen containing compounds: e.g., triphenylmethyl chloride, triphenylmethyl bromide 2-bromoacetic acid, 2-bromoethanol and dichlorobenzophenone.

The silver halide forming component is used stoichiometrically in a small amount per organic silver salt. Thus, it is preferably 0.001 to 0.7 mol, and more preferably 0.03 to 0.5 mol per mol of organic silver salt. The reaction is performed preferably in the presence of polymer as a binder, wherein the polymer to be used is preferably 0.01 to 100 weight parts, and more preferably 0.1 to 10 weight parts per 1 weight part of an organic silver salt.

The thus formed photosensitive silver halide can be chemically sensitized with a sulfur containing compound, gold compound, platinum compound, palladium compound, silver compound, tin compound,. chromium compound or their combination. The method and procedure for chemical sensitization are described in U.S. Pat. No. 4,036,650, British Patent 1,518,850, JP-A 51-22430, 51-78319 and 51-81124. As described in U.S. Pat. No. 3,980,482, a low molecular weight amide compound may be concurrently present to enhance sensitivity at the time of converting a part of the organic silver salt to photosensitive silver halide.

To improve reciprocity law failure or adjust contrast, the photosensitive silver halide may be contained with metal ions of the 6th group to 10th group in the periodical table, such as Rh, Ru, Re, Ir, Os, Fe and their complexes and complex ions. Specifically, complex ions are preferred, e.g., Ir complex ions such as $IrCl_6^{2-}$ are preferably contained to improve reciprocity law failure.

Silver halie grains used in this invention may be subjected to chemically sensitization. Preferred examples of chemical sensitization include sulfur sensitization, selenium sensitization, tellurium sensitization, noble metal sensitization by the use of gold compounds or platinum, palladium or iridium compounds, and reduction sensitization. Preferred compounds used in the sulfur sensitization, selenium sensitization and tellurium sensitization include those commonly known in the art and the compounds described in JP-A 7-128768. Preferred examples of the compounds used in the-noble metal sensitization include chloroauric acid, potassium chloroaurate, potassium aurothiocyanate, gold sulfide, gold selenide and the compounds described in U.S. Pat. No. 2,448,060 and British Patent 618,061. Exemplary compounds used in the reduction sensitization include stannous chloride, aminoiminomethanesulfinic acid, hydrazine derivatives, borane compounds, silane compounds, polyamine compounds as well as ascorbic acid and thiourea dioxide. The reduction sensitization can be undergone by ripening the emulsion, while maintaining at a pH of 7.8 or less or pAg of 8.3 or less. The reduction sensitization can also accomplished by introducing a single addition of a silver ion during the process of grain formation.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

In the present invention, organic silver salts have an average grain diameter of 2 $\mu$m or less and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.05 and 1.5 $\mu$m, and more preferably between 0.05 and 1.0 $\mu$m. Furthermore, the monodisperse as described herein is the same as silver halide grains and preferred monodispersibility is not more than 50%, more preferably not more than 40%, and still more preferably 0.1 to 30%. It is also preferred that at least 60% of the total of the organic silver salt is accounted for by tabular grains. The tabular grains refer to grains having a ratio of an average grain diameter to grain thickness, i.e., aspect ratio (denoted as AR) of 3 or more:

AR=average diameter ($\mu$m)/thickness ($\mu$m)

To obtain such tabular organic silver salts, organic silver salt crystals are pulverized together with a binder or surfactant, using a ball mill. Thus, using these tabular grains, photosensitive materials exhibiting high density and superior image fastness are obtained.

To prevent hazing of the photosensitive material, the total amount of silver halide and organic silver salt is preferably 0.5 to 2.2 g in equivalent converted to silver per $m^2$, leading to high contrast images.

The photothermographic material according to this invention comprises on a support at least an image forming layer. Further, at least a non-image forming layer is preferably provided on the image forming layer. To control the amount or wavelength distribution of light passing through the image forming layer, there may be provided a filter layer on the image forming layer-side or an anti-halation dye layer, so-called a backing layer on the opposite side. Alternatively, a dye or pigment may be incorporated into the image forming layer. As a dye used may be any compound having the intended absorption with the desired wavelength region, including, for example, compounds described in JP-A 59-6481, and 59-182436; U.S. Patent 4,271,263 and 4,594,312; European Patent-A 533,000 and 652,473; JP-A 2-216140, 4-348339, 7-191432 and 7-301890.

The non-image forming layer may be added with the binder or matting agent afore-described and a lubricant such as polysiloxane compounds, waxes, and liquid paraffin. The image forming layer may be comprised of plural layers, for example, high-speed layer/low-speed layer or low-speed layer/high-speed layer may be arranged to adjust the contrast.

The photothermographic material used in this invention, which forms photographic images through heat-development, contains a reducible silver source (an organic silver salt), light sensitive silver halide, a reducing agent and optionally a tone modifier to modify silver image tone, which are preferably in the form of a dispersion dispersed in a conventional (organic) binder matrix. The photothermographic material is usually stable at ordinary temperatures and developed when, after exposure, heated at a high temperature (e.g., 80 to 140° C.). On heating, silver is formed through oxidation-reduction reaction between an organic silver salt (acting as an oxidant) and a reducing agent. The oxidation-reduction reaction is catalyzed by silver latent images photolytically formed from silver halide. Silver formed from the reaction of the organic silver salt in the exposed area provide black images and contrasts the unexposed area, leading to image formation. This reaction process proceeds without supplying a processing solution such as water.

Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963, and include the following: aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxyphenyl)methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols. As hindered phenols, listed are compounds represented by the general formula (A) described below:

Formula (A)

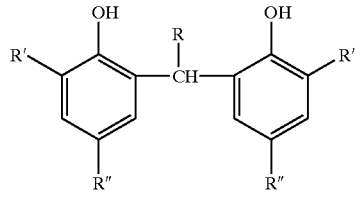

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Exemplary examples of the compounds represented by the formula (A) are shown below.

A-1

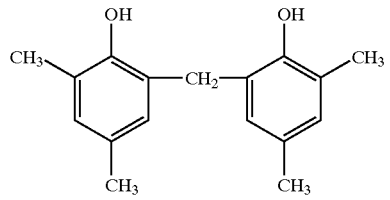

A-2

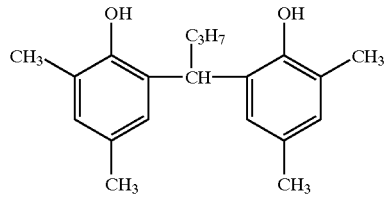

-continued

A-3

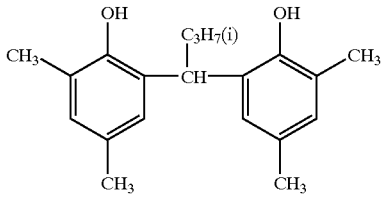

A-4

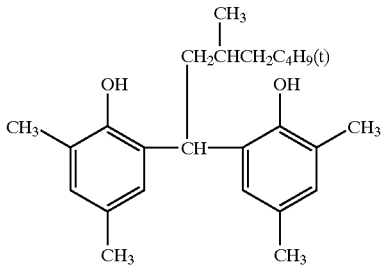

A-5

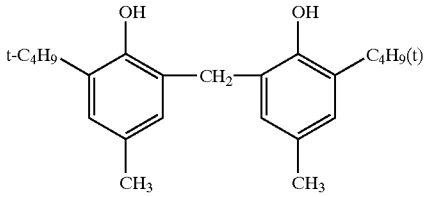

A-6

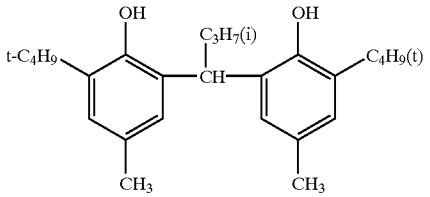

A-7

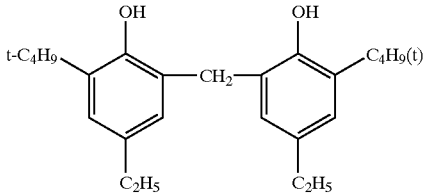

The used amount of reducing agents represented by the above-mentioned general formula (A) is preferably between $1\times10^{-2}$ and 10 moles, and is more preferably between $1\times10^{-2}$ and 1.5 moles per mole of silver.

In the photothermographic materials is used an additive, called an image toning agent, image tone modifier or activating toner (hereinafter, called as tone modifier). one modifiers participate in the oxidation-reduction reaction between an organic silver salt and a reducing agent, having a function of making formed silver image tone black. xamples of preferred tone modifiers, which are disclosed in Research Disclosure Item 17029, include the following:

imides (for example, phthalimide), cyclic imides, pyrazoline-5-one, and quinazolinone (for example, succinimide, 3-phenyl-2-pyrazoline-5-on, 1-phenylurazole, quinazoline and-2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(l-carbamoyl-3,5-dimethylpyrazole), 1,8-( 3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H, 4H-2,3a, 5,6a-tatraazapentalene). Preferred tone modifiers include phthalazone or phthalazine.

To enhance effects of this invention, it is preferred to incorporate a contrast-increasing agent into the image forming layer side. As the contrast-increasing agent is preferred hydrazine derivatives, vinyl compounds and quaternary onium compounds. The vinyl compound and quaternary onium compound are represented by the following formulas (G) and (P), respectively:

formula (G)

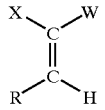

formula (P)

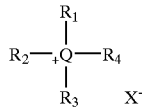

In formula (G), X and R are represented as a cis-form, but X and R in a trans-form are also included in the formula (A). This is the same in exemplary compounds described later.

The hydrazine derivatives are represented by the following formula (H):

Formula (H)

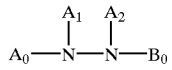

In the formula, $A_0$ is an aliphatic group, aromatic group, heterocyclic group, each of which may be substituted, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which Go is a —CO—, —COCO—, —CS—, —C(=$NG_1D_1$)—, —SO—, —$SO_2$— or —P(O) ($G_1D_1$)— group, in which $G_1$ is a linkage group, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is an aliphatic group, aromatic group, heterocyclic group, amino group, alkoxy group, aryloxy group, alkylthio group or arylthio group. $D_0$ is preferably a hydrogen atom, an alkyl group, an alkoxy group or an amino group.

In Formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy,-alkylthio, arylthio, sulfooxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ of formula (H) is preferably a monocyclic or condensed-polycyclic one containing at least one hetero-atom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or —$G_0$—$D_0$ group represented by $A_0$ each may be substituted. Specifically preferred $A_0$ is an aryl group or —$G_0$—$D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In Formula (H), $B_0$ is a blocking group, and preferably —$G_0$—$D_0$, wherein $G_0$ is a —CO—, —COCO—, —CS—, —C(=$NG_1D_1$)—, —SO—, —$SO_2$— or —P(O)($G_1D_1$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxyl or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxalyl).

A compound represented by formula [H] is exemplified as below, but the present invention is not limited thereto.

H-1

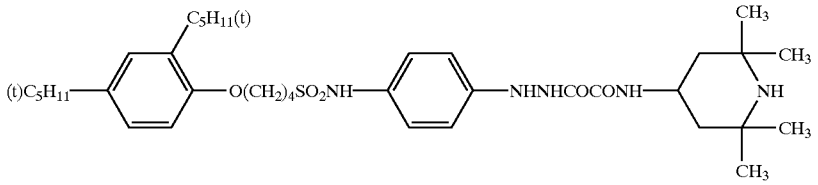

H-2

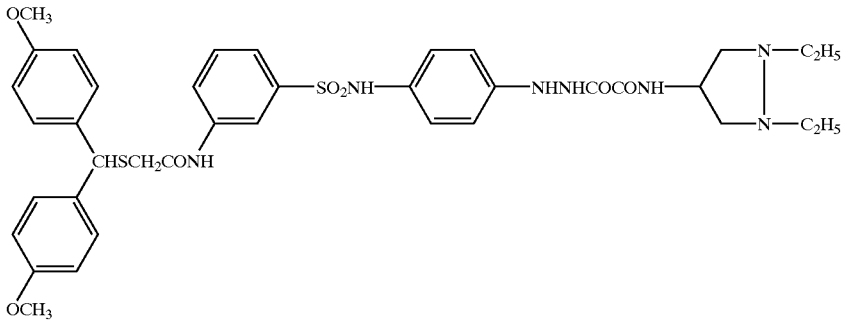

H-3

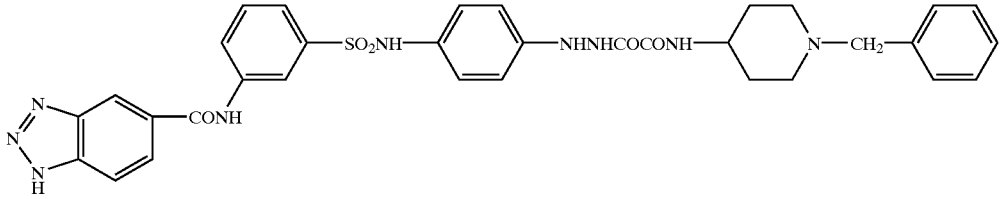

-continued
H-4
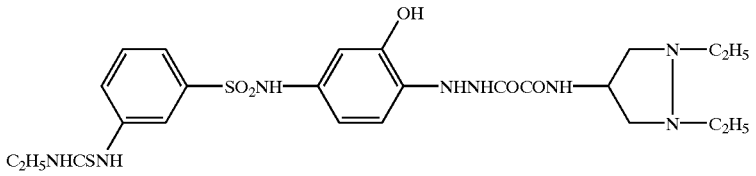
H-5
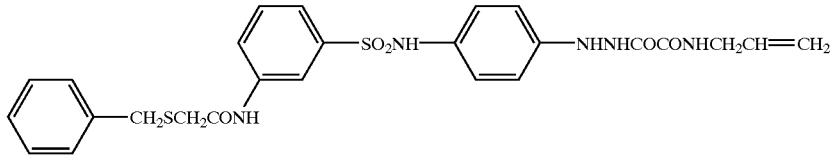
H-6
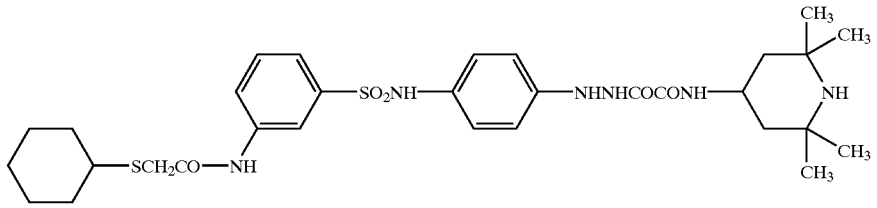
H-7
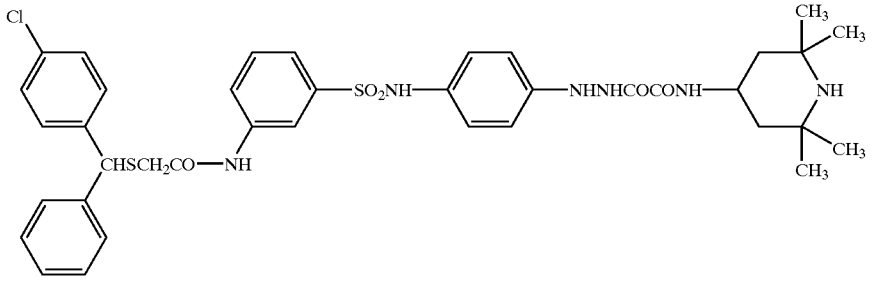
H-8
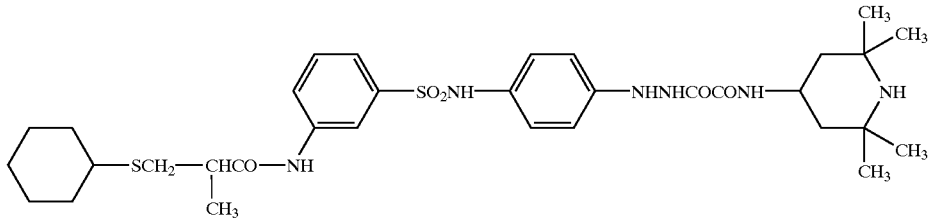
H-9
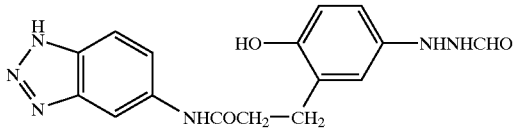
H-10
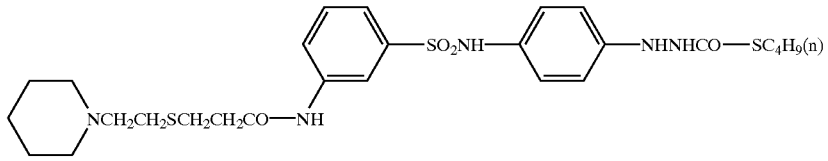
H-11
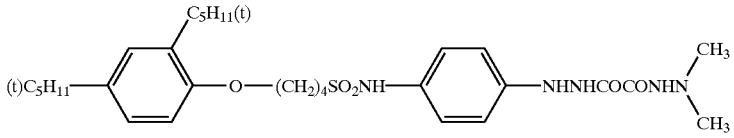

-continued
H-12
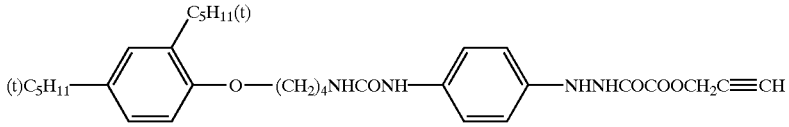
H-13
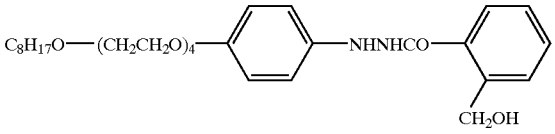
H-14
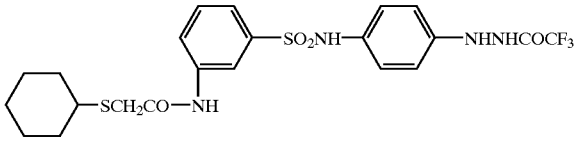
H-15
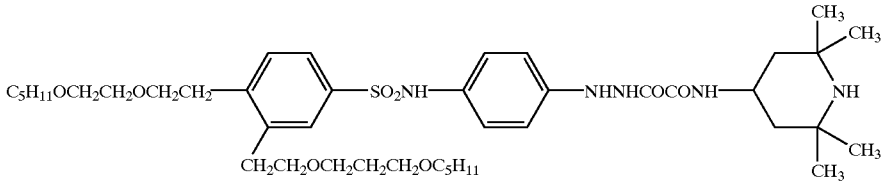
H-16
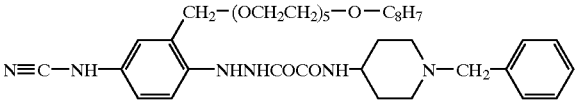
H-17
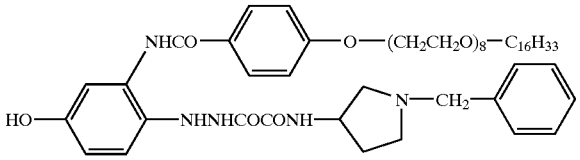
H-18
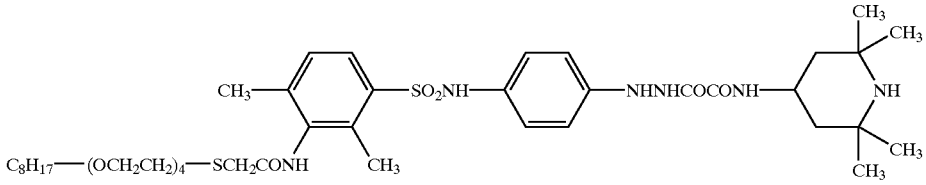
H-19
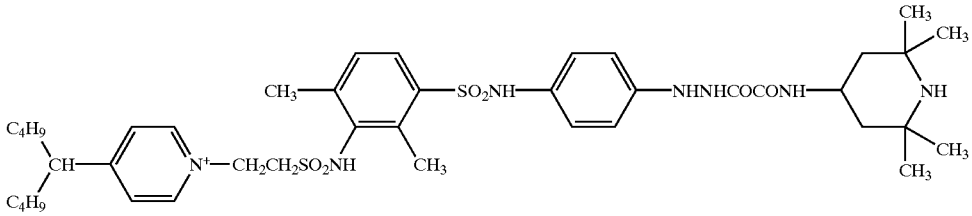
H-20
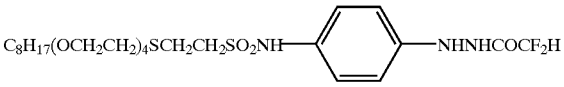
H-21
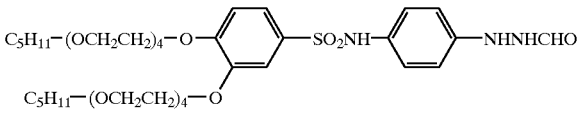
H-22
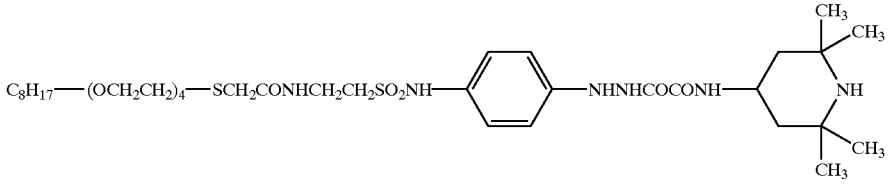

-continued
H-23
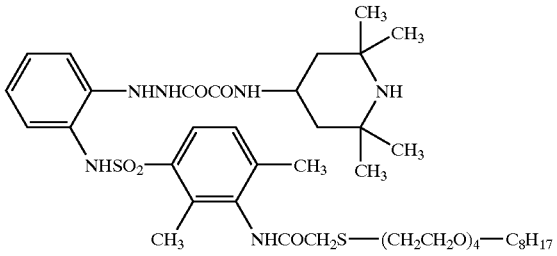
H-24
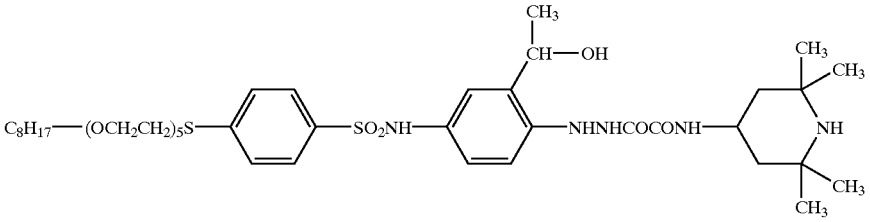
H-25
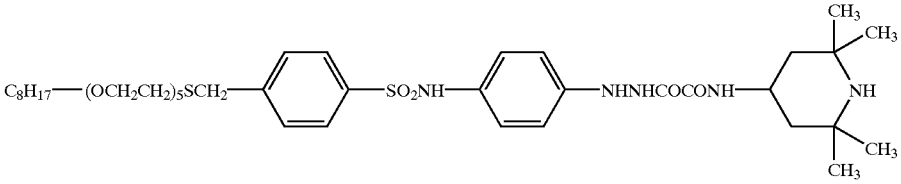
H-26
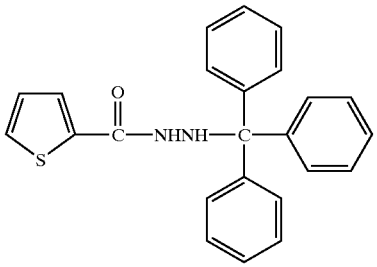
H-27
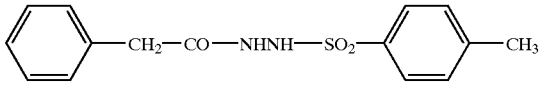
H-28
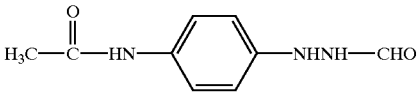
H-29
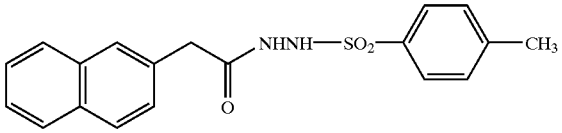
H-30
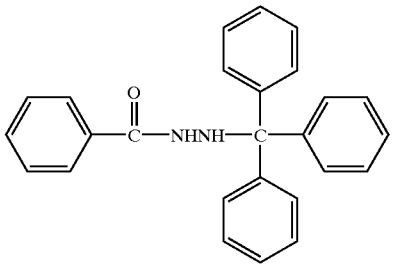
H-31
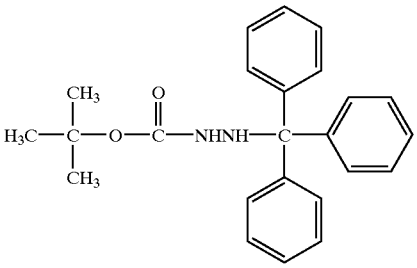

-continued

H-32

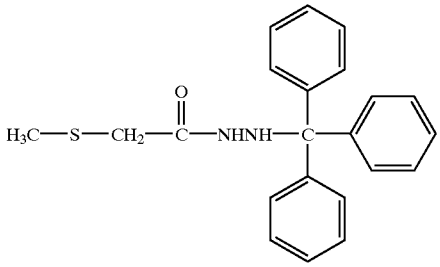

H-33

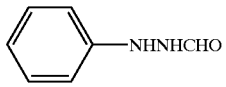

H-34

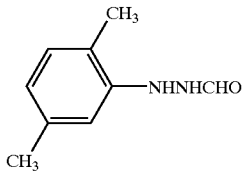

H-35

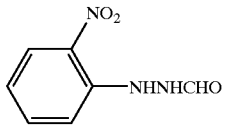

More preferred hydrazine derivatives are those which are represented by the following formulas (H-1), (H-2), (H-3), and (H-4):

formula (H-1)

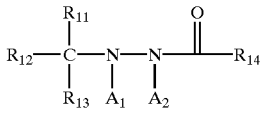

formula (H-2)

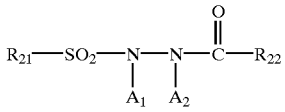

formula (H-3)

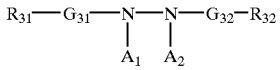

formula (H-4)

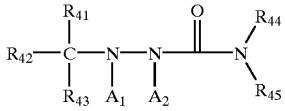

In formula (H-1), $R_{11}$, $R_{12}$ and $R_{13}$ are each a substituted or unsubstituted aryl group or substituted or unsubstituted heteroary group. Examples of the aryl group represented by $R_{11}$, $R_{12}$ or $R_{13}$ include phenyl, p-methylphenyl and naphthyl and examples of the heteroaryl group include a triazole residue, imidazole residue, pyridine residue, furan residue and thiophene residue. $R_{11}$, $R_{12}$ or $R_{13}$ may combine together with each other through a linkage group. Substituents which $R_{11}$, $R_{12}$ or $R_{13}$ each may have include, for example, an alkyl group, an alkenyl group, an alkynyl group, an aryl group, a heterocyclic group, a quaternary nitrogen containing heterocyclic group (e.g., pyridionyl), hydroxy, an alkoxy group (including containing a repeating unit of ethyleneoxy or propyleneoxy), an aryloxy group, an acyloxy group, an acyl group, an alkoxycarbonyl group, an aryloxycarbonyl group, a carbamoyl group, a urethane group, carboxy, an imodo group, an amino group, a carbonamido group, a sulfonamido group, a ureido group, a thioureido group, a sulfamoylamino group, semicarbazido group, thiosemocarbaido group, hydrazine group, a quaternary ammonio group, an alkyl-., aryl- or heterocyclic-thio group, mercapto- group, an alkyl- or aryl-sufonyl group, an alkyl- or aryl-sulfinyl group, sulfo group, sulfamoyl group, an acylsufamoyl group, an alkyl or aryl-sulfonylureido group, an alkyl- or aryl-sulfonylcarbamoyl group, a halogen atom, cyano, nitro, and phosphoric acid amido group. All of $R_{11}$, $R_{12}$ and $R_{13}$ are preferably phenyl groups and more preferably unsubstituted phenyl groups.

Examples of the heteroaryl group represented by $R_{14}$ include a pyridyloxy group, benzimidazolyl group, benzothiazolyl group, benzimidazolyloxy group, furyloxy group, thienyloxy group, pyrazolyloxy group, and imidazolyloxy group; and examples of the the heteroarylthio group include a pyridylthio group, pyrimidylthio group, indolylthio group, benzothiazolylthio, benzoimidazolylthio group, furylthio group, thienylthio group, pyrazolylthio group, and imidazolylthio group. $R_{14}$ is preferably a pyridyloxy or thenyloxy group.

$A_1$ and $A_2$ are both hydrogen atoms, or one of them is a hydrogen atom and the other is an acyl group (e.g., acetyl, trifluoroacetyl, benzoyl, etc.), alkylsulfonyl group (e (e.g., ehoxalyl, etc.) $A_1$ and $A_2$ are preferably both hydrogen atoms.

In formula (H-2), $R_{21}$ is a substituted or unsubstituted alkyl group, aryl group or heteroaryl group. Examples of the alkyl group represented by $R_{21}$ include methyl, ethyl, t-butyl, 2-octyl, cyclohexyl, benzyl, and diphenylmethyl; the aryl group, the heteroaryl group and the substituent groups are the same as defined in $R_{11}$, $R_{12}$ and $R_{13}$. $R_{21}$ is preferably an aryl group or a heterocyclic group, and more preferably a phenyl group.

$R_{22}$ is a hydrogen atom, an alkylamino group, an arylamino group, or heteroarylamino group. Examples of the alkylamino group represented by $R_{22}$ include methylamino, ethylamino, propylamino, butylamino, dimethylamino diethylamino, and methylethylamino; examples of the arylamino group include anilino; and examples of the heteroaryl group include thiazolylamino, benzimidazolylamino, and benzthiazolylamino. $R_{22}$ is preferably dimethylamino or diethylamino. $A_1$ and $A_2$ are each the same as defined in formula (H-1).

In formula (H-3), $R_{31}$ and $R_{32}$ each represent a univalent substituent group. Examples of the univalent substituent groups represented by $R_{31}$ and $R_{32}$ are the same as defined in formula (H-1), preferably an alkyl group, an aryl group, a heteroaryl group, an alkoxy group and an amino group, more preferably an aryl group or an alkoxy group, and specifically preferably, at least one of $R_{31}$ and $R_{32}$ is t-butoxycarbonyl. Alternatively, when $R_{31}$ is a phenyl group, $R_{32}$ id tert-butoxy group.

$G_{31}$ and $G_{32}$ are each a —CO—, —COCO— or —C(═S)— group, a sulfonyl group, a sulfoxy group, a —P(═O)$R_{33}$— group, or an iminomethylene group and $R_{33}$ is an alkyl group, an alkenyl group, an alkynyl group, an aryl group, an alkoxy group, an alkenyloxy group, an alkynyloxy group, an arylamino group or an amino group, provided that when $G_{31}$ is a sulfonyl group, $G_{32}$ is not a carbonyl group, and $G_{31}$ and $G_{32}$ are preferably a —CO—, —COCO— or —C(═S)— group, a sulfonyl group, and more preferably both —CO— groups or sulfonyl groups; $R_{31}$ and $R_{32}$ are each a univalent substituent group; and $A_1$ and $A_2$ are each the same as defined in formula (H-1).

In formula (H-4), $R_{41}$, $R_{42}$ and $R_{43}$ are the same as defined in $R_{11}$, $R_{12}$ and $R_{13}$ of formula ula (H-1). $R_{41}$, $R_{42}$ and $R_{43}$ are all phenyl groups, and are more preferably all unsubstituted phenyl groups. $R_{44}$ and $R_{45}$ each represent a substituted or unsubstituted alkyl groups, ncluding, for example, methyl, ethyl, t-butyl, 2-octyl, cyclohexyl, benzyl, and diphenylmethyl, and are preferably both ethyl groups. $A_1$ and $A_2$ are each the same as defined in formula (H-1).

Exemplary examples of the compounds represented by formulas (H-1) through (H-4) are shown below, but are not limited to these.

H-1-11

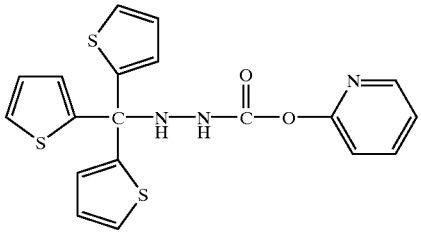

H-1-12

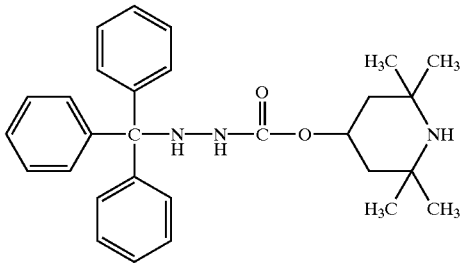

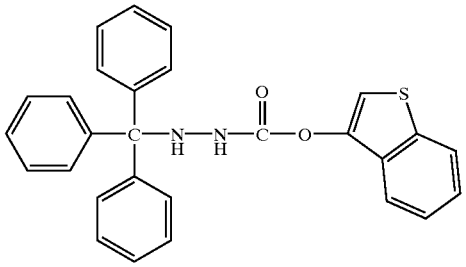

H-2-1

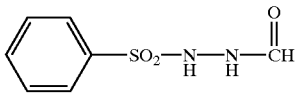

H-2-2

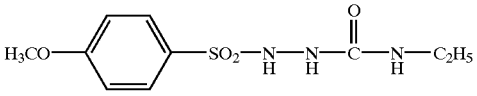

-continued

H-2-3

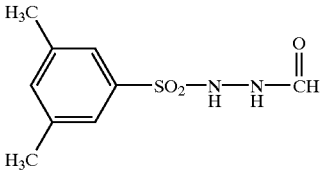

H-2-4

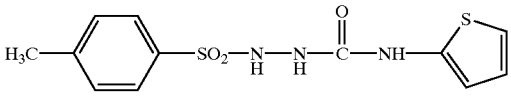

H-2-5

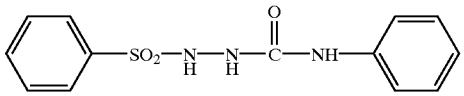

H-2-6

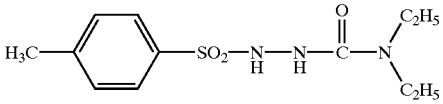

H-2-7

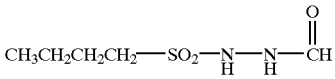

H-2-8

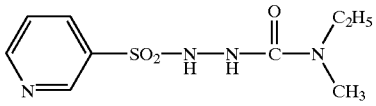

H-2-9

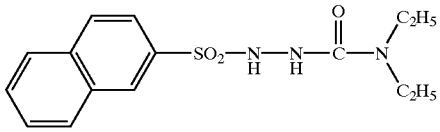

H-3-1

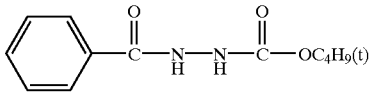

H-3-2

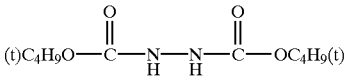

H-3-3

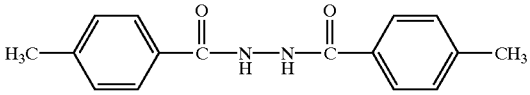

H-3-4

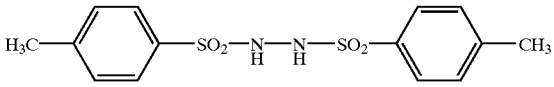

H-3-5

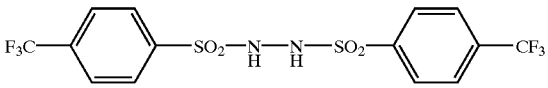

-continued

H-3-6

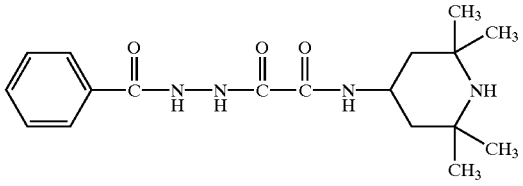

H-3-7

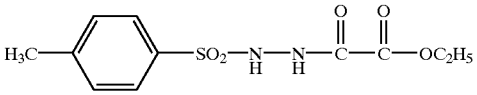

H-3-8

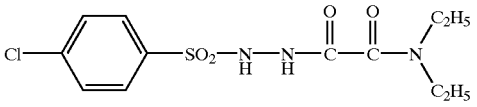

H-3-9

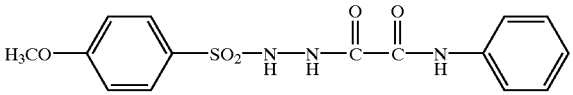

H-3-10

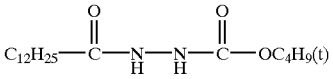

H-3-11

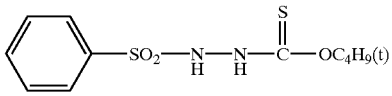

H-3-12

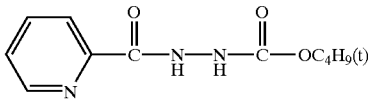

H-4-1

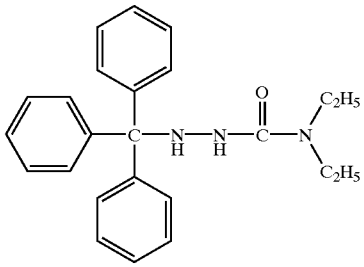

H-4-2

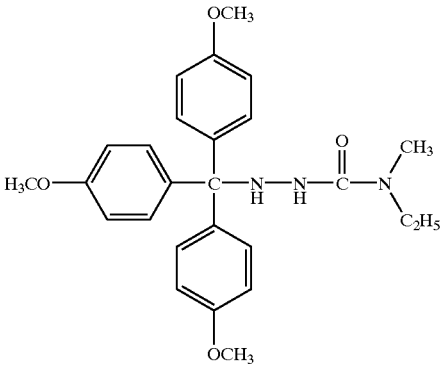

-continued

H-4-3

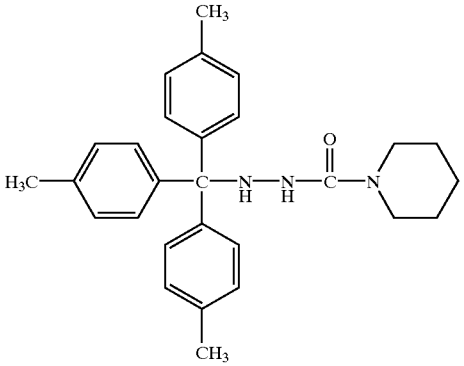

H-4-4

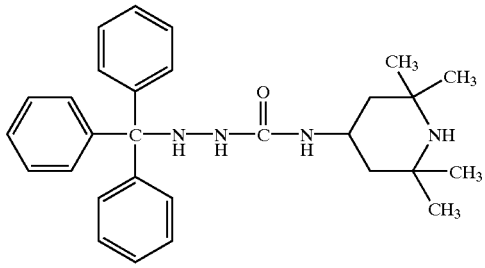

H-4-5

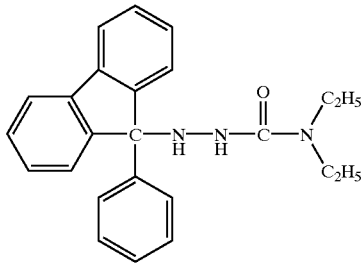

The compounds represented by formulas (H-1) through (H-4) can be readily synthesized according to methods commonly known in the art, for example, referring to the method described in U.S. Pat. Nos. 5,464,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

In the formula (G), X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyaxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino grou, a N-carbonylimino group, a N-sulfonylimino group, a dicyanoethylene group, an ammonium group, a sulfonium group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the rinf formed by X and W include pyrazolone, pyrazolidinone, cyclopentadione, β-ketolactone, and β-ketolactam.

In the formula (G), the electron-withdrawing group represented by X refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonnium group, a phophonium group, pyrilium group and inmonium Igrou, and further including a group of a heterocyclic ring formed by an ammonium group, sulfonium group, phosphonium group or immonium group. Of these group, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive op is preferred and the group exhibiting op of 0.3 or more is specifically preferred.

Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

Exemplary examples of the compounds represented by formula (G) are shown below, but are not limited to these.

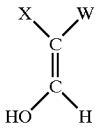

| X | W | | | | |
|---|---|---|---|---|---|
| | —$COCH_3$ | —$COCF_3$ | 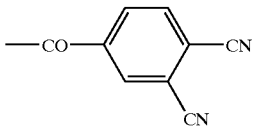 | —CHO | —$COCH_2SCH_3$ |
| —$COOC_2H_5$ | 1-1 | 2-1 | 3-1 | 4-1 | 5-1 |
| —$COCOOC_2H_5$ | 1-2 | 2-2 | 3-2 | 4-2 | 5-2 |
| —$COCF_3$ | 1-3 | 2-3 | 3-3 | 4-3 | 5-3 |
| —$SO_2CH_3$ | 1-4 | 2-4 | 3-4 | 4-4 | 5-4 |
| —CHO | 1-5 | — | 3-5 | 4-5 | 5-5 |
| —$COCH_3$ | 1-6 | — | 3-6 | — | 5-6 |
| —$COCH_2SCH_3$ | — | — | 3-7 | — | 5-7 |
| —$SO_2CF_3$ | 1-7 | 2-5 | 3-8 | 4-6 | 5-8 |
| 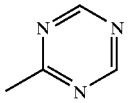 | 1-8 | 2-6 | 3-9 | 4-7 | 5-9 |
| —$COOC_2H_4SCH_3$ | 1-9 | 2-7 | 3-10 | 4-8 | 5-10 |
| —$COCOOC_2H_4SCH_3$ | 1-10 | 2-8 | 3-11 | 4-9 | 5-11 |
| —$COCONHC_2H_4SCH_3$ | 1-11 | 2-9 | 3-12 | 4-10 | 5-12 |

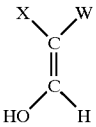
| X | W: —COCOCH$_3$ | W: —COCOOC$_2$H$_5$ | W: —COCOSC$_2$H$_5$ |
|---|---|---|---|
| —COOC$_2$H$_5$ | 6-1 | 7-1 | 8-1 |
| —COCOOC$_2$H$_5$ | 6-2 | 7-2 | 8-2 |
| —COCH$_3$ | 6-3 | — | 8-3 |
| —COCF$_3$ | 6-4 | — | 8-4 |
| —SO$_2$CH$_3$ | 6-5 | 7-3 | 8-5 |
| —SO$_2$CF$_3$ | 6-6 | 7-4 | 8-6 |
| —CHO | 6-7 | — | 8-7 |
| —COCH$_2$SCH$_3$ | 6-8 | — | 8-8 |
| 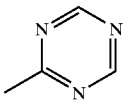 | 6-9 | 7-5 | 8-9 |
| —COOC$_2$H$_4$SCH$_3$ | 6-10 | 7-6 | 8-10 |
| —COCOOC$_2$H$_4$SCH$_3$ | 6-11 | 7-7 | 8-11 |
| —COCONHC$_2$H$_4$SCH$_3$ | 6-12 | 7-8 | 8-12 |
| 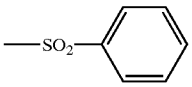 | 6-13 | 7-9 | — |
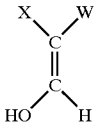
| X | W: —COCONHC$_2$H$_4$SCH$_3$ | W: —C(=S)—CH$_3$ | W: —COOC$_2$H$_5$ | W: —COSC$_2$H$_5$ |
|---|---|---|---|---|
| —COOC$_2$H$_5$ | 9-1 | 10-1 | 11-1 | 12-1 |
| —COCOOC$_2$H$_5$ | 9-2 | 10-2 | — | 12-2 |
| —COCH$_3$ | — | 10-3 | — | 12-3 |
| —COCF$_3$ | — | 10-4 | — | 12-4 |
| —SO$_2$CH$_3$ | 9-3 | 10-5 | 11-2 | 12-5 |
| —SO$_2$CF$_3$ | 9-4 | 10-6 | 11-3 | 12-6 |
| —CHO | — | 10-7 | — | 12-7 |
| —COCH$_2$SCH$_3$ | — | 10-8 | — | 12-8 |
| 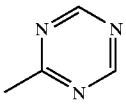 | 9-5 | 10-9 | 11-4 | 12-9 |
| —COOC$_2$H$_4$SCH$_3$ | 9-6 | 10-10 | 11-5 | 12-10 |
| —COCOOC$_2$H$_4$SCH$_3$ | 9-7 | 10-11 | 11-6 | 12-11 |
| —COCONHC$_2$H$_4$SCH$_3$ | 9-8 | 10-12 | — | 12-12 |
| 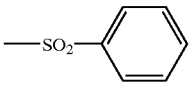 | — | — | 11-7 | — |

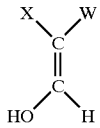
| X | W | | |
|---|---|---|---|
| | —CONH— 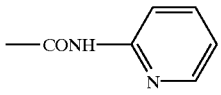 | —CSNH— 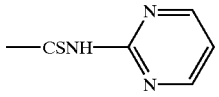 | —$SO_2CH_3$ |
| —$COOC_2H_5$ | 13-1 | 14-1 | 15-1 |
| —$COCOOC_2H_5$ | 13-2 | 14-2 | 15-2 |
| —$COCH_3$ | 13-3 | 14-3 | — |
| —$COCF_3$ | 13-4 | 14-4 | — |
| —$SO_2CH_3$ | 13-5 | 14-5 | 15-3 |
| —$SO_2CF_3$ | 13-6 | 14-6 | 15-4 |
| —CHO | 13-7 | 14-7 | — |
| —$COCH_2SCH_3$ | 13-8 | 14-8 | — |
| 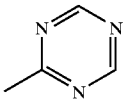 | 13-9 | 14-9 | 15-5 |
| —$COOC_2H_4SCH_3$ | 13-10 | 14-10 | 15-6 |
| —$COCOOC_2H_4SCH_3$ | 13-11 | 14-11 | 15-7 |
| —$COCONHC_2H_4SCH_3$ | 13-12 | 14-12 | 15-8 |
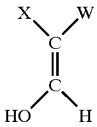
| X | W | | | | |
|---|---|---|---|---|---|
| | —$SO_2CF_3$ | —$SOCH_3$ | —$SO_2OCH_3$ | —$SO_2SCH_3$ | —$SO_2NH_2$ |
| —$COOC_2H_5$ | — | 17-1 | 18-1 | 19-1 | 20-1 |
| —$COCOOC_2H_5$ | — | 17-2 | 18-2 | 19-2 | 20-2 |
| —$COCH_3$ | — | 17-3 | 18-3 | 19-3 | 20-3 |
| —$COCF_3$ | — | 17-4 | 18-4 | 19-4 | 20-4 |
| —$SO_2CH_3$ | — | 17-5 | 18-5 | 19-5 | 20-5 |
| —$SO_2CF_3$ | — | 17-6 | 18-6 | 19-6 | 20-6 |
| —CHO | — | 17-7 | 18-7 | 19-7 | 20-7 |
| —$COCH_2SCH_3$ | — | 17-8 | 18-8 | 19-8 | 20-8 |
| 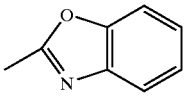 | 16-1 | 17-9 | 18-9 | 19-9 | 20-9 |
| —$COOC_2H_4SCH_3$ | — | 17-10 | 18-10 | 19-10 | 20-10 |
| —$COCOOC_2H_4SCH_3$ | — | 17-11 | 18-11 | 19-11 | 20-11 |
| —$COCONHC_2H_4SCH_3$ | 16-2 | 17-12 | 18-12 | 19-12 | 20-12 |

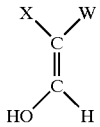
| X | W | | | | |
|---|---|---|---|---|---|
| | $-S(=O)-O-CH_3$ | $-S(=O)-S-C_2H_5$ | $-S(=O)-NHCH_3$ | $-P(=O)(OC_2H_5)-OC_2H_5$ | $-NO_2$ |
| $-COOC_2F_4H$ | 21-1 | 22-1 | 23-1 | 24-1 | 25-1 |
| $-COCOOCH_2C_2F_4H$ | 21-2 | 22-2 | 23-2 | 24-2 | 25-2 |
| $-COCH_3$ | 21-3 | 22-3 | 23-3 | 24-3 | 25-3 |
| $-COCF_3$ | 21-4 | 22-4 | 23-4 | 24-4 | 25-4 |
| $-SO_2CH_3$ | 21-5 | 22-5 | 23-5 | 24-5 | 25-5 |
| $-SO_2CF_3$ | 21-6 | 22-6 | 23-6 | 24-6 | 25-6 |
| $-CHO$ | 21-7 | 22-7 | 23-7 | 24-7 | 25-7 |
| $-COCH_2SCH_3$ | 21-8 | 22-8 | 23-8 | 24-8 | 25-8 |
| 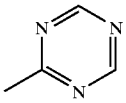 | 21-9 | 22-9 | 23-9 | 24-9 | 25-9 |
| $-COOC_2H_4SCH_3$ | 21-10 | 22-10 | 23-10 | 24-10 | 25-10 |
| $-COCOOC_2H_4SCH_3$ | 21-11 | 22-11 | 23-11 | 24-11 | 25-11 |
| $-COCONHC_2H_4SCH_3$ | 21-12 | 22-12 | 23-12 | 24-12 | 25-12 |
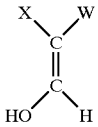
| X | W | | | | |
|---|---|---|---|---|---|
| | 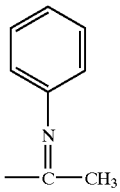 | 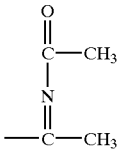 | 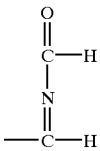 | 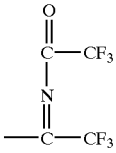 | 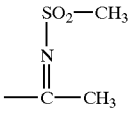 |
| $-COOC_2H_5$ | 26-1 | 27-1 | 28-1 | 29-1 | 30-1 |
| $-COCOOC_2H_5$ | 26-2 | 27-2 | 28-2 | 29-2 | 30-2 |
| $-COCH_3$ | 26-3 | 27-3 | 28-3 | 29-3 | 30-3 |
| $-COCF_3$ | 26-4 | 27-4 | 28-4 | 29-4 | 30-4 |
| $-SO_2CH_3$ | 26-5 | 27-5 | 28-5 | 29-5 | 30-5 |
| $-SO_2CF_3$ | 26-6 | 27-6 | 28-6 | 29-6 | 30-6 |
| $-CHO$ | 26-7 | 27-7 | 28-7 | 29-7 | 30-7 |
| 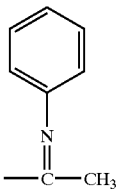 | 26-8 | 27-8 | 28-8 | 29-8 | 30-8 |

-continued
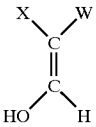
| X | W | | | | |
|---|---|---|---|---|---|
| | 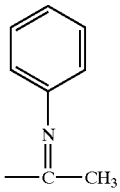 | 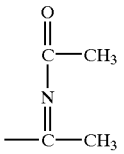 | 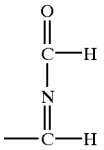 | 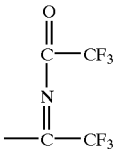 | 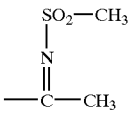 |
| 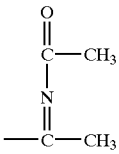 | — | 27-9 | 28-9 | 29-9 | 30-9 |
| 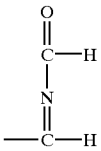 | — | — | 28-10 | 29-10 | 30-10 |
| 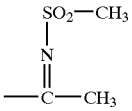 | — | — | — | 29-11 | 30-11 |
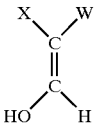
| X | W | | | | |
|---|---|---|---|---|---|
| | 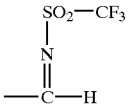 | 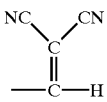 | 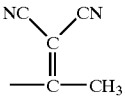 | 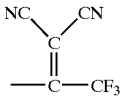 | 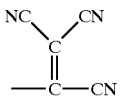 |
| $—COOC_2H_5$ | 31-1 | 32-1 | 33-1 | 34-1 | 35-1 |
| $—COCOOC_2H_5$ | 31-2 | 32-2 | 33-2 | 34-2 | 35-2 |
| $—COCH_3$ | 31-3 | 32-3 | 33-3 | 34-3 | 35-3 |
| $—COCF_3$ | 31-4 | 32-4 | 33-4 | 34-4 | 35-4 |
| —CHO | 31-5 | 32-5 | 33-5 | 34-5 | 35-5 |
| $—SO_2CH_3$ | 31-6 | 32-6 | 33-6 | 34-6 | 35-6 |
| $—SO_2CF_3$ | 31-7 | 32-7 | 33-7 | 34-7 | 35-7 |
| 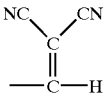 | 31-8 | 32-8 | 33-8 | 34-8 | 35-8 |

-continued
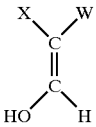
| X | W | | | | |
|---|---|---|---|---|---|
| | 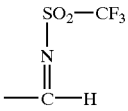 | 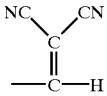 | 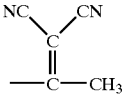 | 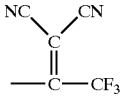 | 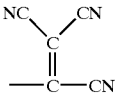 |
| 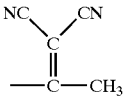 | 31-9 | — | 33-9 | 34-9 | 35-9 |
| 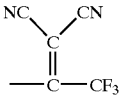 | 31-10 | — | — | 34-10 | 35-10 |
| 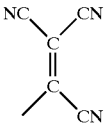 | 31-11 | — | — | — | 35-11 |
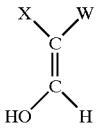
| X | W | | | | |
|---|---|---|---|---|---|
| | —$CF_3$ | —CH═CH—CN | —CH═CH—CHO | —C≡C—$CF_3$ | —C≡C—CN |
| —$COOC_2H_5$ | 36-1 | 37-1 | 38-1 | 39-1 | 40-1 |
| —$COCOOC_2H_5$ | 36-2 | 37-2 | 38-2 | 39-2 | 40-2 |
| —$COCF_3$ | 36-3 | 37-3 | 38-3 | 39-3 | 40-3 |
| —$SO_2CH_3$ | 36-4 | 37-4 | 38-4 | 39-4 | 40-4 |
| —$COCH_3$ | 36-5 | 37-5 | 38-5 | 39-5 | 40-5 |
| —$SO_2CF_3$ | 36-6 | 37-6 | 38-6 | 39-6 | 40-6 |
| —CHO | 36-7 | 37-7 | 38-7 | 39-7 | 40-7 |
| —$COCH_2SCH_3$ | 36-8 | 37-8 | 38-8 | 39-8 | 40-8 |
| 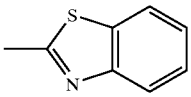 | 36-9 | 37-9 | 38-9 | 39-9 | 40-9 |
| —$COOC_2H_4SCH_3$ | 36-10 | 37-10 | 38-10 | 39-10 | 40-10 |
| —$COCOOC_2H_4SCH_3$ | 36-11 | 37-11 | 38-11 | 39-11 | 40-11 |
| —$COCONHC_2H_4SCH_3$ | 36-12 | 37-12 | 38-12 | 39-12 | 40-12 |

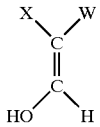
| X | W | | | Cl | H |
|---|---|---|---|---|---|
| | 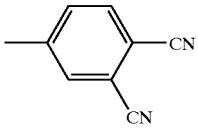 | 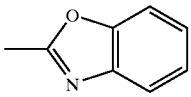 | 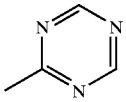 | | |
| —$COOC_2H_5$ | 41-1 | 42-1 | 43-1 | 44-1 | 45-1 |
| —$COCOOC_2H_5$ | 41-2 | 42-2 | 43-2 | 44-2 | 45-2 |
| —$COCH_3$ | 41-3 | 42-3 | — | 44-3 | 45-3 |
| —$COCF_3$ | 41-4 | 42-4 | — | 44-4 | 45-4 |
| —$SO_2CH_3$ | 41-5 | 42-5 | 43-3 | 44-5 | 45-5 |
| —$SO_2CF_3$ | 41-6 | — | 43-4 | 44-6 | 45-6 |
| —CHO | 41-7 | 42-6 | — | 44-7 | 45-7 |
| —$COCH_2SCH_3$ | 41-8 | 42-7 | — | 44-8 | 45-8 |
| 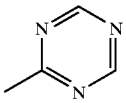 | 41-9 | 42-8 | 43-5 | 44-9 | 45-9 |
| —$COOC_2H_4SCH_3$ | 41-10 | 42-9 | 43-6 | 44-10 | 45-10 |
| —$COCOOC_2H_4SCH_3$ | 41-11 | 42-10 | 43-7 | 44-11 | 45-11 |
| —$COCONHC_2H_4SCH_3$ | 41-12 | 42-11 | 43-8 | 44-12 | 45-12 |
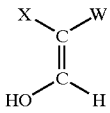
| X | W | | | | |
|---|---|---|---|---|---|
| | 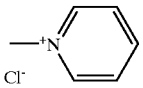 $Cl^-$ | 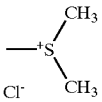 $Cl^-$ | 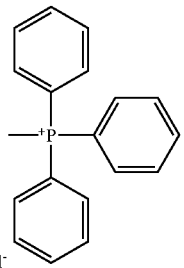 $Cl^-$ | 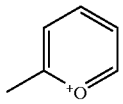 $Br^-$ | 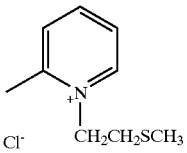 $Cl^-$ |
| —$COOC_2H_5$ | 46-1 | 47-1 | 48-1 | 49-1 | 50-1 |
| —$COCOOC_2H_5$ | 46-2 | 47-2 | 48-2 | 49-2 | 50-2 |
| —$COCH_3$ | 46-3 | 47-3 | 48-3 | 49-3 | 50-3 |
| —$COCF_3$ | 46-4 | 47-4 | 48-4 | 49-4 | 50-4 |
| —$SO_2CH_3$ | 46-5 | 47-5 | 48-5 | 49-5 | 50-5 |
| —$SO_2CF_3$ | 46-6 | 47-6 | 48-6 | 49-6 | 50-6 |
| —CHO | 46-7 | 47-7 | 48-7 | 49-7 | 50-7 |
| —$COCH_2SCH_3$ | 46-8 | 47-8 | 48-8 | 49-8 | 50-8 |
| 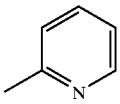 | 46-9 | 47-9 | 48-9 | 49-9 | 50-9 |
| —$COOC_2H_4SCH_3$ | 46-10 | 47-10 | 48-10 | 49-10 | 50-10 |
| —$COCOOC_2H_4SCH_3$ | 46-11 | 47-11 | 48-11 | 49-11 | 50-11 |
| —$COCONHC_2H_4SCH_3$ | 46-12 | 47-12 | 48-12 | 49-12 | 50-12 |

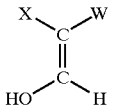
| X | W | |
|---|---|---|
| | 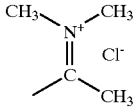 | 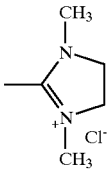 |
| —$COOC_2H_5$ | 51-1 | 52-1 |
| —$COCOOC_2H_5$ | 51-2 | 52-2 |
| —$COCH_3$ | 51-3 | 52-3 |
| —$COCCl_3$ | 51-4 | 52-4 |
| —$SO_2CH_3$ | 51-5 | 52-5 |
| —$SO_2CF_3$ | 51-6 | 52-6 |
| —CHO | 51-7 | 52-7 |
| 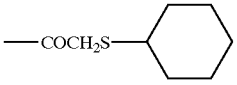 | 51-8 | 52-8 |
-continued
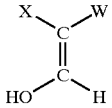
| X | W | |
|---|---|---|
| | 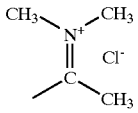 | 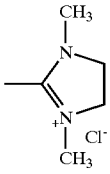 |
| 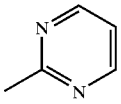 | 51-9 | 5 2 - 9 |
| —$COOC_2H_4SC_2H_5$ | 51-10 | 52-10 |
| —$COCOOC_2H_4SC_2H_5$ | 51-11 | 52-11 |
| 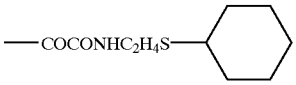 | 51-12 | 52-12 |
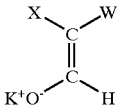
| X | W | | | | |
|---|---|---|---|---|---|
| | —$COCH_3$ | —$COCF_3$ | —CHO | —$COCH_2SCH_3$ | —$SO_2CH_3$ |
| —$COOC_2H_5$ | 53-1 | 54-1 | 55-1 | 56-1 | 57-1 |
| —$COCOOC_2H_5$ | 53-2 | 54-2 | 55-2 | 56-2 | 57-2 |
| —$COCH_3$ | 53-3 | 54-3 | 55-3 | 56-3 | 57-3 |
| —$COCF_3$ | — | 54-4 | 55-4 | 56-4 | 57-4 |
| —CHO | — | — | 55-5 | 56-5 | 57-5 |
| —$SO_2CH_3$ | — | — | — | 56-6 | 57-6 |
| —$SO_2CF_3$ | 53-4 | 54-5 | 55-6 | 56-7 | 57-7 |
| —$COCH_2SCH_3$ | — | — | — | 56-8 | — |
| 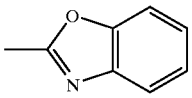 | 53-5 | 54-6 | 55-7 | 56-9 | 57-8 |
| —$COOC_2H_4SCH_3$ | 53-6 | 54-7 | 55-8 | 56-10 | 57-9 |
| —$COCOOC_2H_4SCH_3$ | 53-7 | 54-8 | 55-9 | 56-11 | 57-10 |
| —$COCONHC_2H_4SCH_3$ | 53-8 | 54-9 | 55-10 | 56-12 | 5 7 - 1 1 |

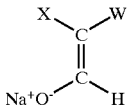
| X | W | | | | |
|---|---|---|---|---|---|
| | $—SO_2CF_3$ | 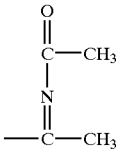 | 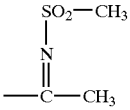 | 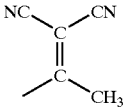 | 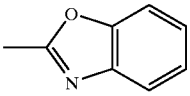 |
| $—COOC_2H_5$ | 58-1 | 59-1 | 60-1 | 61-1 | 62-1 |
| $—COCOOC_2H_5$ | 58-2 | 59-2 | 60-2 | 61-2 | 62-2 |
| $—COCH_3$ | — | 59-3 | 60-3 | 61-3 | — |
| $—COCF_3$ | — | 59-4 | 60-4 | 61-4 | — |
| —CHO | — | 59-5 | 60-5 | 61-5 | — |
| $—SO_2CH_3$ | — | 59-6 | 60-6 | 61-6 | — |
| $—SO_2CF_3$ | 58-3 | 59-7 | 60-7 | 61-7 | 62-3 |
| $—COCH_2SCH_3$ | 58-4 | 59-8 | 60-8 | 61-8 | — |
| 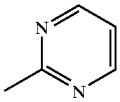 | 58-5 | 59-9 | 60-9 | 61-9 | 62-4 |
| $—COOC_2H_4SCH_3$ | 58-6 | 59-10 | 60-10 | 61-10 | 62-5 |
| $—COCOOC_2H_4SCH_3$ | 58-7 | 59-11 | 60-11 | 61-11 | 62-6 |
| $—COCONHC_2H_4SCH_3$ | 58-8 | 59-12 | 60-12 | 61-12 | 62-7 |
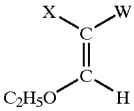
| X | W | | | |
|---|---|---|---|---|
| | $—COCCl_3$ | $—COC_2F_4H$ | —CHO | $—COCH_2SCH_3$ |
| $—COOC_2H_4SCH_3$ | 63-1 | 64-1 | 65-1 | 66-1 |
| $—COCOOC_2H_4SCH_3$ | 63-2 | 64-2 | 65-2 | 66-2 |
| $—COCF_3$ | 63-3 | 64-3 | 65-3 | 66-3 |
| —CHO | 63-4 | 64-4 | 65-4 | 66-4 |
| $—SO_2CH_3$ | 63-5 | 64-5 | 65-5 | 66-5 |
| $—SO_2CF_3$ | 63-6 | 64-6 | 65-6 | 66-6 |
| $—COCH_2SCH_3$ | 63-7 | 64-7 | 65-7 | 66-7 |

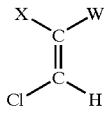
| X | W: —COCF$_3$ | —CHO | —COCH$_2$SCH$_3$ | 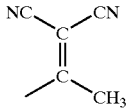 | 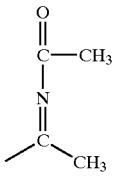 | 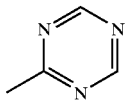 |
|---|---|---|---|---|---|---|
| —COOC$_2$H$_5$ | 67-1 | 67-2 | — | 67-4 | 67-6 | — |
| —COCH$_2$SCH$_3$ | — | — | 67-3 | — | — | — |
| —COCH$_3$ | — | — | — | — | — | 67-5 |
68-1
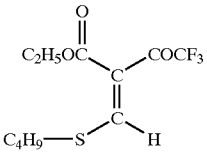
68-2
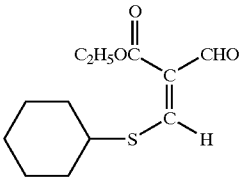
68-3
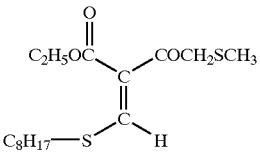
68-4
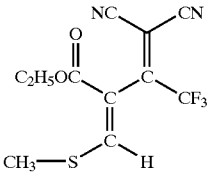
68-5
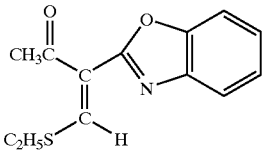
68-6
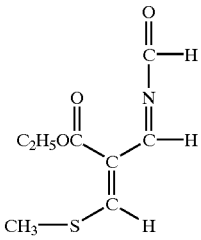
69-1
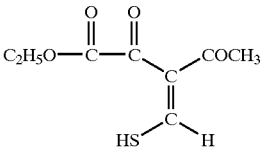
69-2
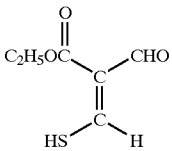
70-1
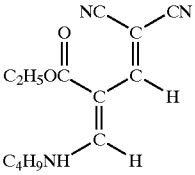
71-1
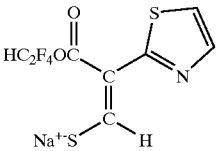
71-2
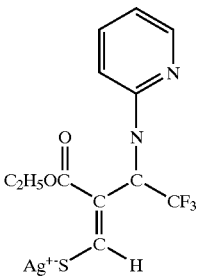

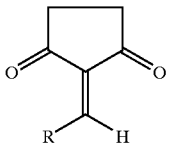
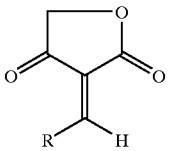
| R: | | | R: | | |
|---|---|---|---|---|---|
| | —OH | 72-1 | | —OH | 72-2 |
| | $—OC_2H_5$ | 72-4 | | $—O^-Na^+$ | 72-3 |
| | $—SCH_3$ | 72-7 | | $—OCH_3$ | 72-5 |
| | | | | $—O^-Ag^+$ | 72-6 |
| | | | | $—SC_4H_9$ | 72-8 |
| | | | | $—S^-K^+$ | 72-9 |
| | | | | —Cl | 72-11 |
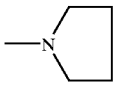
72-10
-continued
72-13
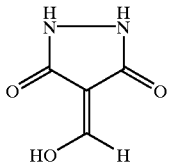
72-14
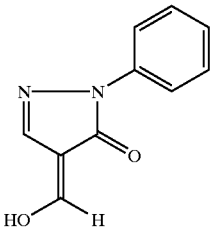
72-15
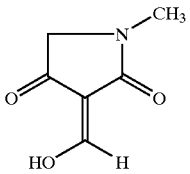
72-16
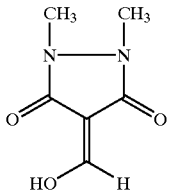
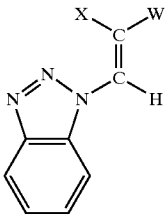
| X | W | | | | |
|---|---|---|---|---|---|
| | $—COCH_3$ | $—COCF_3$ | —CHO | $—COCH_2SCH_3$ | $—SO_2CH_3$ |
| $—COOC_2H_5$ | 73-1 | 74-1 | 75-1 | 76-1 | 77-1 |
| $—COCOOC_2H_5$ | 73-2 | 74-2 | 75-2 | 76-2 | 77-2 |
| $—COCH_3$ | 73-3 | 74-3 | 75-3 | 76-3 | 77-3 |
| $—COCF_3$ | — | 74-4 | 75-4 | 76-4 | 77-4 |
| —CHO | — | — | 75-5 | 76-5 | 77-5 |
| $—SO_2CH_3$ | — | — | — | 76-6 | 77-6 |
| $—SO_2CF_3$ | 73-4 | 74-5 | 75-6 | 76-7 | 77-7 |
| $—COCH_2SCH_3$ | — | — | — | 76-8 | — |
| 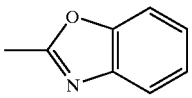 | 73-5 | 74-6 | 75-7 | 76-9 | 77-8 |
| $—COOC_2H_4SCH_3$ | 73-6 | 74-7 | 75-8 | 76-10 | 77-9 |
| $—COCOOC_2H_4SCH_3$ | 73-7 | 74-8 | 75-9 | 76-11 | 77-10 |
| $—COCONHC_2H_4SCH_3$ | 73-8 | 74-9 | 75-10 | 76-12 | 77-11 |

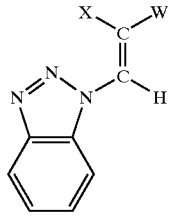
| X | W | | | | |
|---|---|---|---|---|---|
| | —$SO_2CF_3$ | 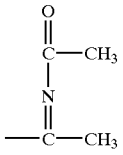 | 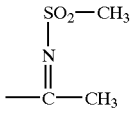 | 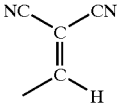 | 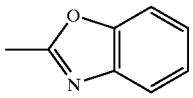 |
| —$COOC_2H_5$ | 78-1 | 79-1 | 80-1 | 81-1 | 82-1 |
| —$COCOOC_2H_5$ | 78-2 | 79-2 | 80-2 | 81-2 | 82-2 |
| —$COCH_3$ | — | 79-3 | 80-3 | 81-3 | — |
| —$COCF_3$ | — | 79-4 | 80-4 | 81-4 | — |
| —CHO | — | 79-5 | 80-5 | 81-5 | — |
| —$SO_2CH_3$ | — | 79-6 | 80-6 | 81-6 | — |
| —$SO_2CF_3$ | 78-3 | 79-7 | 80-7 | 81-7 | 82-3 |
| —$COCH_2SCH_3$ | 78-4 | 79-8 | 80-8 | 81-8 | — |
| 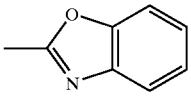 | 78-5 | 79-9 | 80-9 | 81-9 | 82-4 |
| —$COOC_2H_4SCH_3$ | 78-6 | 79-10 | 80-10 | 81-10 | 82-5 |
| —$COCOOC_2H_4SCH_3$ | 78-7 | 79-11 | 80-11 | 81-11 | 82-6 |
| —$COCONHC_2H_4SCH_3$ | 78-8 | 79-12 | 80-12 | 81-12 | 82-7 |
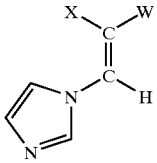
| X | W | | | | |
|---|---|---|---|---|---|
| | —$COCH_3$ | —$COCF_3$ | —CHO | —$COCH_2SCH_3$ | —$SO_2CH_3$ |
| —$COOC_2H_5$ | 83-1 | 84-1 | 85-1 | 86-1 | 87-1 |
| —$COCOOC_2H_5$ | 83-2 | 84-2 | 85-2 | 86-2 | 87-2 |
| —$COCH_3$ | 83-3 | 84-3 | 85-3 | 86-3 | 87-3 |
| —$COCF_3$ | — | 84-4 | 85-4 | 86-4 | 87-4 |
| —CHO | — | — | 85-5 | 86-5 | 87-5 |
| —$SO_2CH_3$ | — | — | — | 86-6 | 87-6 |
| —$SO_2CF_3$ | 83-4 | 84-5 | 85-6 | 86-7 | 87-7 |
| —$COCH_2SCH_3$ | — | — | — | 86-8 | — |
| 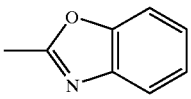 | 83-5 | 84-6 | 85-7 | 86-9 | 87-8 |
| —$COOC_2H_4SCH_3$ | 83-6 | 84-7 | 85-8 | 86-10 | 87-9 |
| —$COCOOC_2H_4SCH_3$ | 83-7 | 84-8 | 85-9 | 86-11 | 87-10 |
| —$COCONHC_2H_4SCH_3$ | 83-8 | 84-9 | 85-10 | 86-12 | 87-11 |

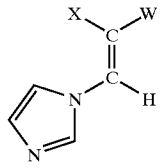

W

| X | $—SO_2CF_3$ | $—C(=O)—N=C—H$ | $—SO_2—CH_3$ $—N=C—H$ | $NC—C(=CN)—C—H$ | 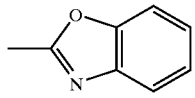 |
|---|---|---|---|---|---|
| $—COOC_2H_5$ | 88-1 | 89-1 | 90-1 | 91-1 | 92-1 |
| $—COCOOC_2H_5$ | 88-2 | 89-2 | 90-2 | 91-2 | 92-2 |
| $—COCH_3$ | — | 89-3 | 90-3 | 91-3 | — |
| $—COCF_3$ | — | 89-4 | 90-4 | 91-4 | — |
| —CHO | — | 89-5 | 90-5 | 91-5 | — |
| $—SO_2CH_3$ | — | 89-6 | 90-6 | 91-6 | — |
| $—SO_2CF_3$ | 88-3 | 89-7 | 90-7 | 91-7 | 92-3 |
| $—COCH_2SCH_3$ | 88-4 | 89-8 | 90-8 | 91-8 | — |
| 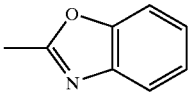 | 88-5 | 89-9 | 90-9 | 91-9 | 92-4 |
| $—COOC_2H_4SCH_3$ | 88-6 | 89-10 | 90-10 | 91-10 | 92-5 |
| $—COCOOC_2H_4SCH_3$ | 88-7 | 89-11 | 90-11 | 91-11 | 92-6 |
| $—COCONHC_2H_4SCH_3$ | 88-8 | 89-12 | 90-12 | 91-12 | 92-7 |

In formula (P), Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ combine together with each other to form a ring; and $X^-$ is an anion.

Examples of the substituent represented by $R_1$, $R_2$, $R_3$ and $R_4$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g.,piperidyl, piperazinyl, morpholinyl, pyridyl, furyl, thienyl, tetrahydrofuryl, tetrahydrothienyl, sulforanyl), and amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluenesulfonic acid ion.

Further, quaternary onium salt compounds usable in this invention include compounds represented by formulas (Pa), (Pb) and (Pc), or formula (T):

formula (Pa)

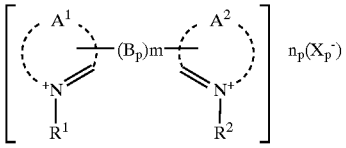

-continued formula (Pb)

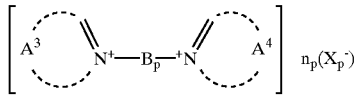

formula (Pc)

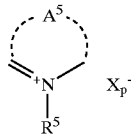

wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, hydroxy, an alkoxyl group, an aryloxy group, an amido group, a sulfamoyl group, a carbamoyl group, a ureido group, an amino group, a sulfonamido group, cyano, nitro, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene group, arylene group, alkenylene group, $—SO_2—$, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituent thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted. $X_p^-$ is a counter ion necessary to counterbalance overall charge of the molecule, such as chloride ion, bromide ion, iodide ion, sulfate ion, nitrate ion and p-toluenesulfonate ion; $n_p$ is a counter ion necessary to counterbalance overall charge of the molecule and in the case of an intramolecular salt, $n_p$ is 0.

Formula (T)

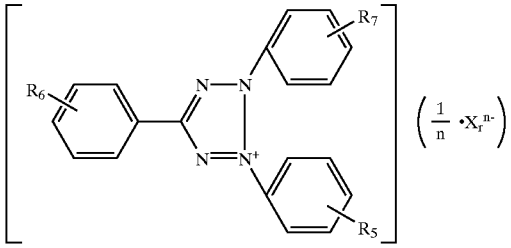

In formula (T), substituent groups $R_5$, $R_6$ and $R_7$, substituted on the phenyl group are preferably a hydrogen atom or a group, of which Hammett's σ-value exhibiting a degree of electron attractiveness is negative.

The a values of the substituent on the phenyl group are disclosed in lots of reference books. For example, a report by C. Hansch in "The Journal of Medical Chemistry", vol.20, on page 304(1977), etc. can be mentioned. Groups showing particularly preferable negative σ-values include, for example, methyl group ($\sigma_p$=−0.17, and in the following, values in the parentheses are in terms of $\sigma_p$ value), ethyl group(−0.15), cyclopropyl group(−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the formula T according to the present invention; n is 1 or 2, and as anions represented by $X_T^{n-}$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonic anion, etc.; higher alkylbenzene sulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkylsulfo succinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned.

Exemplary examples of the quaternary onium compounds are shown below, but are not limited to these.

P-1

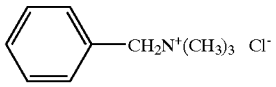

$C_{16}H_{33}{}^+N(CH_3)_3$ $Br^-$

P-3

$^+N(C_4H_9)_4$ $Cl^-$

P-4

$(CH_3)_3{}^+NCH_2CH_2OH$ $Cl^-$

P-5

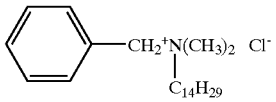

P-6

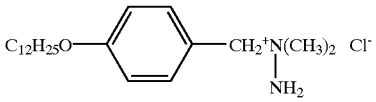

P-7

$(C_2H_5)_2{}_+N(CH_2)_4{}_+N(C_2H_5)_2$ $2Cl^-$

P-8

$(C_4H_9)_3{}^+NCH_2CH_2{}^+N(C_4H_9)_3$ $SO_4^{2-}$

P-9

$(C_2H_5)_3{}^+N(CH_2)_8{}^+(C_2H_5)_3$ $2Cl^-$

P-10

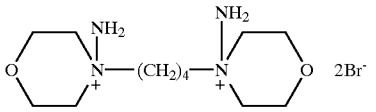

P-11

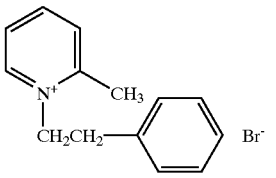

P-12

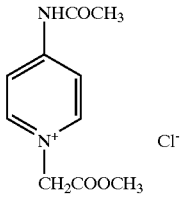

-continued
P-13
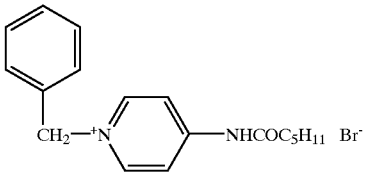
P-14
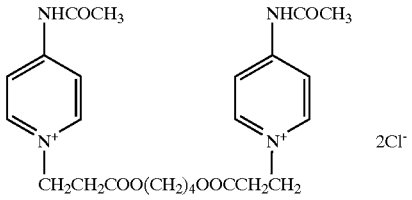
P-15
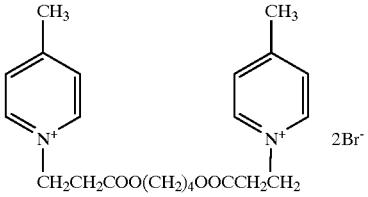
P-16
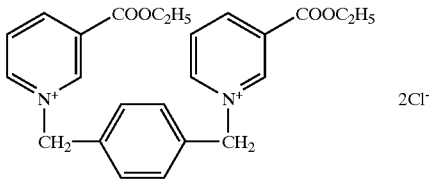
P-17
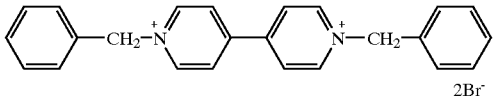
P-18
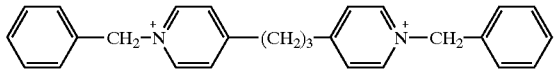
P-19
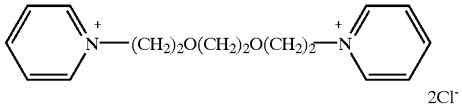
P-20
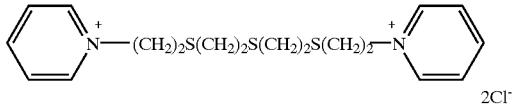
P-21
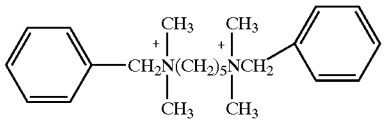
P-22
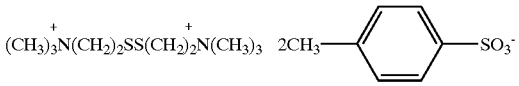
P-23
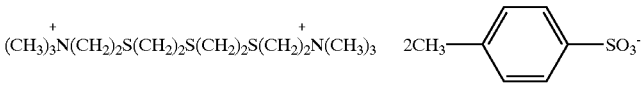
P-24
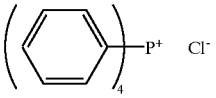
P-25
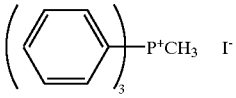
P-26
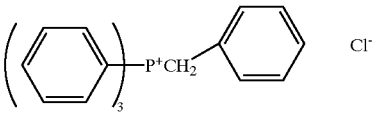
P-27
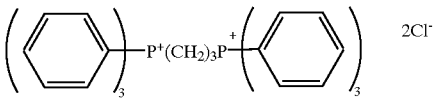
P-28
P-29
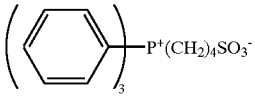
P-30
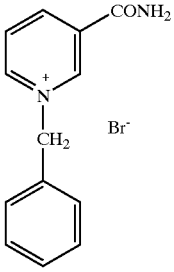
P-31
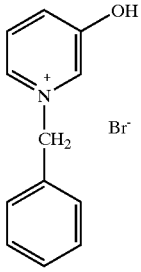

-continued
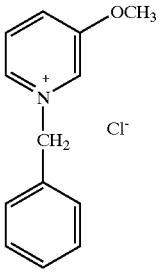
P-32
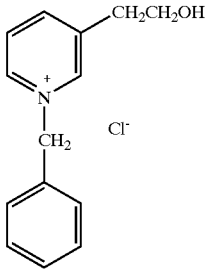
P-33
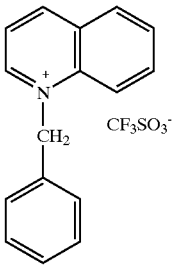
P-34
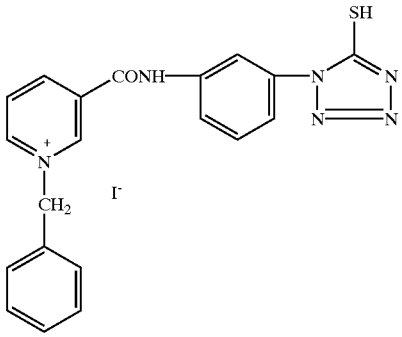
P-35
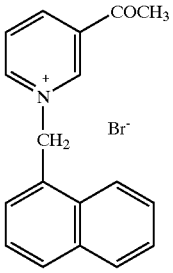
P-36
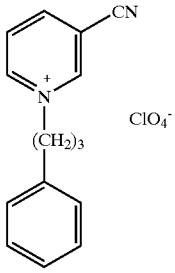
P-37
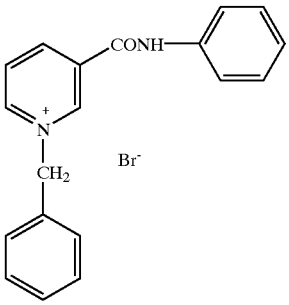
P-38
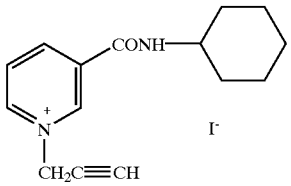
P-39
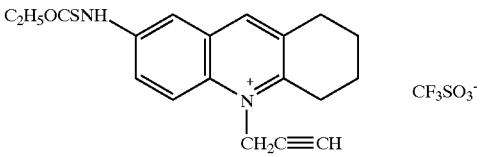
P-40
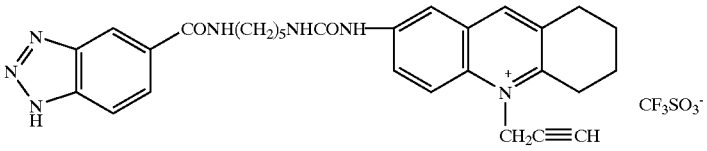
P-41

-continued
P-42
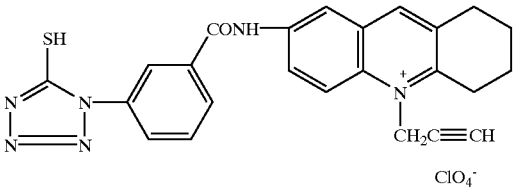
P-43
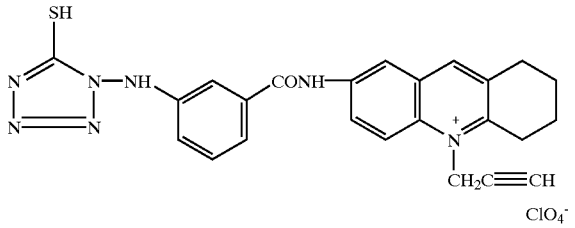
P-44
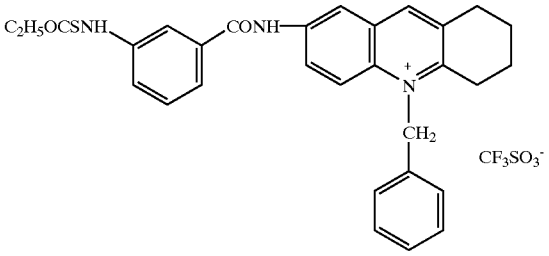
P-45
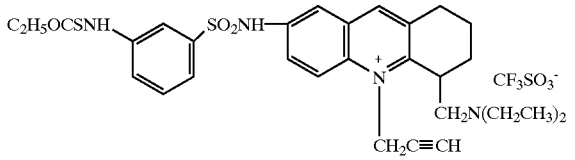
P-46
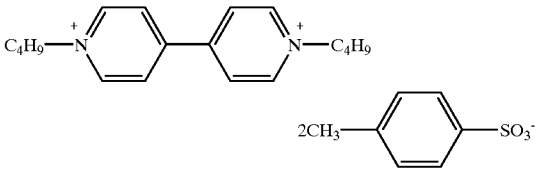
P-47
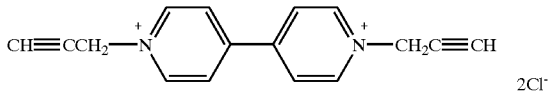
P-48
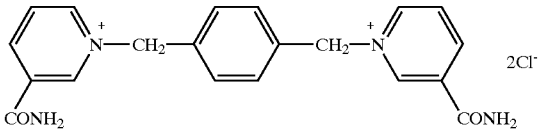
P-49
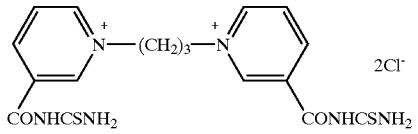
P-50
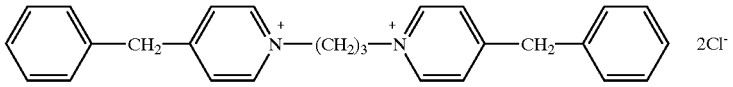
P-51
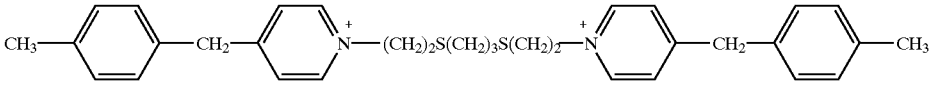
P-52
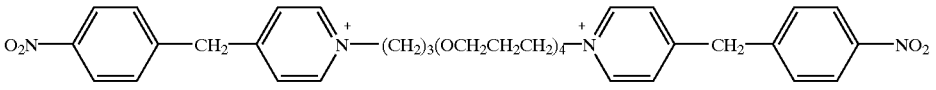
P-53
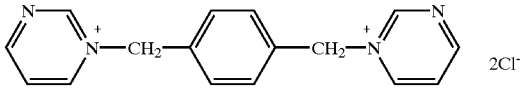
P-54
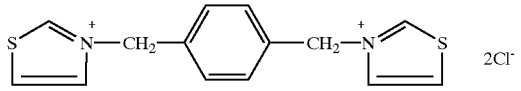
P-55
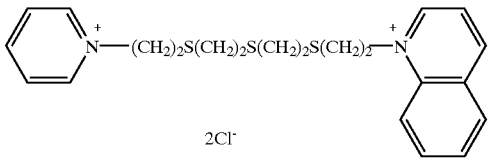

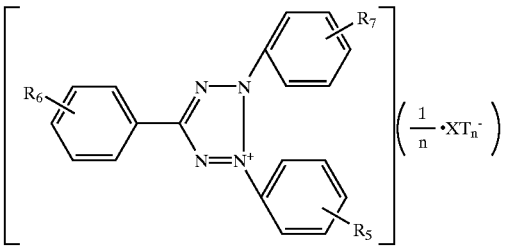

| Compd. No. | $R_5$ | $R_6$ | $R_7$ | $X_T^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The quaternary onium salt compounds described above can be readily synthesized according to the methods commonly known in the art. For example, the tetrazolium compounds described above may be referred to Chemical Review 55, page 335–483.

In the photothermographic material used in invention, employed can be sensitizing dyes described, for example, in JP-A 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978). Particularly, selected can advantageously be sensitizing dyes having the spectral sensitivity suitable for spectral characteristics of light sources of various types of scanners. For example, compounds described in JP-A 9-34078, 9-54409 and 9-80679 are preferably employed.

Specifically in cases when being supersensitized, photosensitivity is enhanced so that silver printed-out after development tends to increase when the reducing agent is not deactivated. In cases when being infrared-sensitized, a infrared-sensitizing dye has an oxidation-reduction potential capable of slightly reducing silver halide and an organic silver salt, so that silver cluster forming fogged silver is easily formed in the presence of a reducing agent capable of reducing the organic silver salt, even when being allowed to stand in the dark. The thus formed silver cluster acts as a catalyst nucleus to induce fogging, leading to deteriorated storage stability when allowed to stand in the dark and an increase of printed-out silver when being allowed to stand under ambient light. Further, an infrared-sensitive photothermographic material exhibits sensitivity to heat radiation ray region outside the visible region. Therefore, the present invention is effective, and is markedly effective in infrared-sensitive photothermographic materials.

These sensitizing dyes may be used alone or in combination thereof. The combined use of sensitizing dyes is often employed for the purpose of supersensitization. A supersensitizing compound, such as a dye which does not exhibit spectral sensitization or substance which does not substantially absorb visible light may be incorporated, in combination with a sensitizing dye, into the emulsion. Useful sensitizing dyes, dye combinations exhibiting supersensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432.

In the invention, an aromatic heterocyclic mercapto compound represented by the following formula (6) is preferred as a supersensitizer:

Ar—SM Formula (6)

wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar Formula (7)

wherein Ar is the same as defined in formula (6).

The aromatic heterocyclic rings described above may be substituted with a halogen atom (e.g., Cl, Br, I), a hydroxy group, an amino group, a carboxy group, an alkyl group (having one or more carbon atoms, and preferablyl to 4 carbon atoms) or an alkoxy group (having one or more carbon atoms, and preferablyl to 4 carbon atoms).

Exemplary examples of mercapto-substituted aromatic heterocyclic compound are shown below but are not limited to these.

M-1: 2-mercaptobenzimidazole
M-2: 2-mercaptobenzoxazole
M-3: 2-mercaptobenzthiazole
M-4: 5-methyl-2-mercaptobenzimidazole
M-5: 6-ethoxy-2-mercaptobenzthiazole
M-6: 2,2'-dithiobis(benzthiazole)
M-7: 3-mercapto-1,2,4-triazole
M-8: 4,5-diphenyl-2-imidazole
M-9: 2-mercaptoimidazole
M-10: 1-ethyl-2-mercaptobenzimidazole
M-11: 2-mercaptoquinoline
M-12: 8-mercaptopurine
M-13: 2-mercapto-4(3H)-quinazoline
M-14: 7-trifluoromethyl-4-quinolinethiol
M-15: 2,3,5,6-tetrachloro-4-pyridinethiol
M-16: 4-amino-6-hydroxy-2-mercaptopyridine monohydrate M-17: 2-amino-5-mercapto-1,3,4-thiazole
M-18: 3-amino-5-mercapto-1,2,4-triazole
M-l9: 4-hydroxy-2-mercaptopyridine
M-20: 2-mercaptopyridine
M-21: 4,6-diamino-2-mercaptopyridine
M-22: 2-mercapto-4-methylpyrimidine hydrochloride
M-23: 3-mercapto-5-phenyl-1,2,4-riazole
M-24: 2-mercapto-4-phenyloxazole The supersensitizer compound usable in the invention is incorporated into an emulsion layer containing the organic silver salt and silver halide grains, preferably in an amount of 0.001 to 1.0 mol, and more preferably 0.01 to 0.5 mol per mol of silver.

Antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and P-A 59-57234.

To improve the density variation after being aged under high temperature and high humidity, it ie effective to use an oxidizing agent to reduce fogging after development. Preferred examples of such an oxidizing agent include compounds described in JP-A 50-119624, 50-120328, 51-121332, 54-58022, 56-70543, 56-99335, 59-90842, 61-129642, 62-129845, 6-208191, 7-5621, 7-2781, 8-15809; U.S. Pat. Nos. 5,340,712, 5,369,000, 5,464,737, 3,874,946, 4,756,999, 5,340,712; European Patent 605,981A1, 622,666A1, 631,176A1; JP-A 7-2781; U.S. Pat. Nos. 4,180,665, and 4,442,202. Specifically, a compound represented by the following formula (I) is preferred:

formula (I)

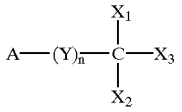

wherein A represents an aliphatic group, an aromatic group or a heterocyclic group; $X_1$, $X_2$ and $X_3$ each represent a hydrogen atom or an electron withdrawing group, which may be the same or different; Y is a divalent linkage group; and n is 0 or 1.

The electron withdrawing group represented by a group exhibiting σp of 0.01 or more, and more preferably 0.1 or more. The Hammett substituent constant (including this σp) is referred to Journal of Medical Chemistry, vol.16, No.11 page 1207–1216 (1973). Examples of the electron withdrawing group include a halogen atom [e.g., fluorine atom (σp: 0.06), chlorine atom (σp:0.23), bromine atom (σp:0.23), iodine atom (σp:0.18)], a trihalomethyl group [tribromomethyl (σp:0.29), trichloromethyl (σp:0.33), trifluoromethyl (σp:0.54)], cyano group (σp:0.66), nitro group (σp:0.78), an aliphatic-, aryl- or heterocyclic-sulfonyl group [e.g., methanesulfonyl (σp:0.72)], an aliphatic-, aryl- or heterocyclic-acyl group [e.g., acetyl (σp:0.50), benzoyl (σp:0.43)],an alkynyl group [e.g., $C_3H_3$ (σp:0.09)], an aliphatic-, aryl- or heterocyclic-oxycarbonyl group [e.g., methoxycarbonyl (σp:0.45), phenoxycarbonyl (σp:0.45)], a carbamoyl group (σp:0.36), and a sulfamoyl group (σp:0.57).

$X_1$, $X_2$ and $X_3$ are each preferably an electron withdrawing group, and more preferably a halogen atom [e.g., fluorine atom (σp: 0.06), chlorine atom (σp:0.23), bromine atom (σp:0.23), iodine atom (σp:0.18)], a trihalomethyl group [tribromomethyl (σp:0.29), trichloromethyl (σp:0.33), trifluoromethyl (σp:0.54)], cyano group (σp:0.66), nitro group (σp:0.78), an aliphatic-, aryl- or heterocyclic-sulfonyl group [e.g., methanesulfonyl (σp:0.72)], an aliphatic-, aryl- or heterocyclic-acyl group [e.g., acetyl (σp:0.50), benzoyl (σp:0.43)],an alkynyl group [e.g., $C_3H_3$ (σp:0.09)], an aliphatic-, aryl- or heterocyclic-oxycarbonyl group [e.g., methoxycarbonyl (σp:0.45), phenoxycarbonyl (σp:0.45)], a carbamoyl group (σp:0.36), and a sulfamoyl group (σp:0.57). Of these, a halogen atom is specifically preferred, and of halogen atoms, chlorine atom, bromine atom and iodine atom are preferred, chlorine and bromine atoms are more preferred, and bromine atom is still more preferred.

Y represents a divalent linkage group. Examples thereof include —$SO_2$—, —SO—, —CO—, N($R_{11}$)—$SO_2$—, —N($R_{11}$)—CO—, —N($R_{11}$)—COO—, —COCO—, —COO—, —OCO—, —OCOO—, —SCO—, —SCOO—, —C($Z_1$) ($Z_2$)—, an alkylene group, an arylenes group, a divalent heterocyclic group and a divalent linkage group formed by combination of these groups. $Z_1$ and $Z_2$ are a hydrogen atom or an electron-withdrawing group, provided that both are not hydrogen atoms at the same time. The electron withdrawing group is preferably a group exhibiting a σp of 0.01 or more, and more preferably 0.1 or more; and the preferred electron withdrawing groups of $Z_1$ and $Z_2$ are the same as defined in $X_1$, $X_2$ and $X_3$. $Z_1$ and $Z_2$ are each preferably a chlorine atom, bromine atom or iodine atom; more preferably a chlorine atom or bromine atom, and still more preferably a bromine atom. Y is preferably —$SO_2$—, —SO—, or —CO—, and more preferably —$SO_2$—; and n is preferably 1.

The aliphatic group represented by A is a straight-chained, brabched or cyclic alkyl group (preferably having 1 to 30 carbon atoms, more preferably 1 to 20 carbon atoms, and still more preferably 1 to 12 carbon atoms, e.g., metyl, ethyl, isopropyl, tert-butyl, n-octyl, n-decyl, cyclopropyl, cyclopentyl, cyclohexyl, etc.), an alkenyl group (preferably having 2 to 30 carbon atoms, more preferably 2 to 20 carbon atoms, and still more preferably 2 to 12 carbon atoms, e.g., vinyl, allyl, 2-butenyl, 3-pentenyl, etc.), an alkynyl group (preferably 2 to 30 carbon atoms, more preferably 2 to 20 carbon atoms, and still more preferably 2 to 12 carbon atoms, e.g., propargyl, 2-pentenyl, etc.), each of which may be substituted. Of these aliphatic hydrocarbon groups, an alkyl group is preferred and a straight-chained alkyl group is more preferred. The aromatic group represented by A is preferably an aryl group; the aryl group is preferably a monocyclic or dicyclic aryl group having 6 to 30 carbon atoms (e.g., phenyl, naphthyl, etc.), and more preferably a phenyl group having 6 to 20 carbon atoms, and more preferably 6 to 12 carbon atoms. The aryl group may be substituted; and examples of the substituent include a carboxyl group, acyl group, amino group, sulfonylamino group, carbamoyl group, sulfamoyl group, oxycarbonylamino group and ureido group. The heterocyclic group represented by A is a saturated or unsaturated 3- to 10-membered heterocycle containing at least of N, O and S, which may be a monocyclic or may form a condensed ring with other ring. The heterocyclic group represented by A is preferably a 5- or 6-membered aromatic heterocyclic group, more preferably a nitrogen containing, 5- or 6-membered aromatic heterocyclic group, and sill more preferably a one or two nitrogen containing, 5- or 6-membered aromatic heterocyclic group. Examples of the heterocycle include pyrrolidine, piperidine, piperazine, morpholine, thiophene, furan, pyrrole, imidazole, pyrazolo, pyridine, pyradine, pyridazine, triazole, triazine, indole, indazole, purine, thiadiazole, oxadiazole, quinoline, phthalazine, naphthylidine, quinoxaline, cinnoline, pteridine, acrydine, phenthroline, phenazine, tetrazole, thiazole, oxazole, benzimidazole, benzoxazole, benzthiazole, and indolenine. Of these are preferred thiophene, furan, pyrrole, imidazole, pyrazolo, pyridine, pyradine, pyridazine, triazole, triazine, indole, indazole, thiadiazole, oxadiazole, quinoline, phthalazine, naphthylidine, quinoxaline, quinazolone, cinnoline, pteridine, tetrazole, thiazole, oxazole, benzimidazole, benzoxazole, benzthiazole, and indolenine. further, pyridine, triazine, quinoline, thiadiazole, benzthiazole, and oxadiazole are more preferred, and pyridine, quinoline, thiadiazole and oxadiazole are still more preferred.

Of the polyhalogen compound described above, exemplary examples of the compound represented by formula (I-a) is more preferred:

formula (I-a)

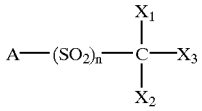

wherein A, $X_1$, $X_2$, $X_3$, $X_4$ and n are each the dame as defined in formula (I), and the preferred range is the same as in formula (I).

Exemplary examples of the polyhalogen compounds used in this invention are shown below but are not limited to these.

0-1

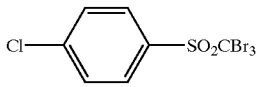

0-2

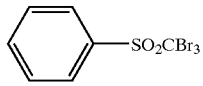

0-3

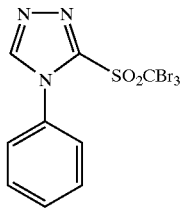

0-4

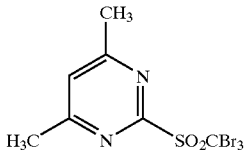

0-5

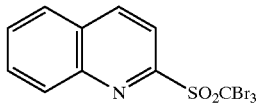

0-6

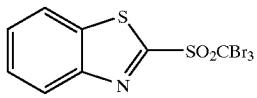

-continued 0-7

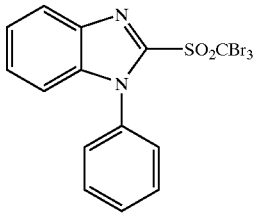

0-8

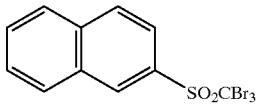

0-9

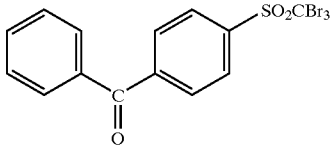

0-10

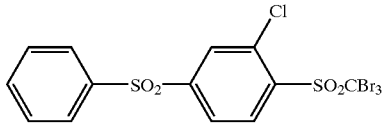

0-11

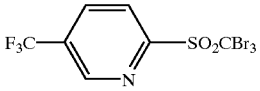

0-12

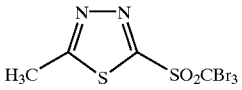

0-13

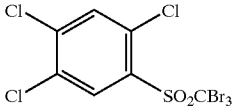

0-14

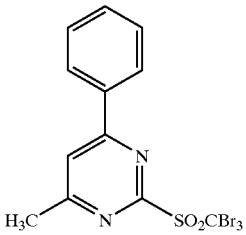

0-15

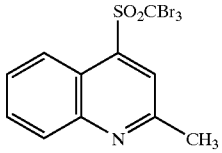

0-16

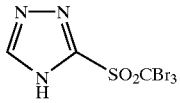

0-17

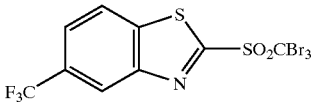

-continued 0-18

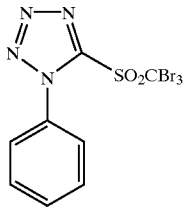

0-19

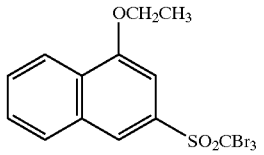

0-20

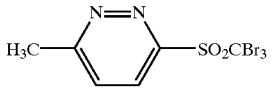

0-21

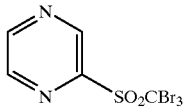

0-22

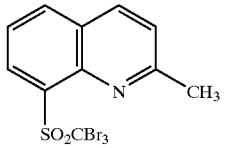

The oxidizing agent used in this invention is preferably contained in an amount of 10 mg/m$^2$ to 3 g/m$^2$, and more preferably 50 mg/m$^2$ to 1 g/m$^2$. The oxidizing agent may be incorporated in any form of a solution, powder, and a solid particle dispersion, and preferably into the image forming layer in a solid particle dispersion. There may be used a dispersing aid in the dispersing process. Further, it may be incorporated in a solution mixed with another additive such as a sensitizing dye, reducing agent or a tone modifier.

Besides the oxidizing agents described above, examples of suitable antifoggants include compounds described in U.S. Pat. Nos. 3,874,946 and 4,756,999, compounds described in paragraph [0030] through [0036] of JP-A 9-188328 and paragraph [0062] through [0063] of JP-A 9-90550, and compounds disclosed in U.S. Pat. No. 5,028,523 and European Patent 600,587, 631,176 and 605,981.

Binders suitable for the photothermographic material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinylpyrrolidone), casein, starch, poly(acrylic acid), poly(methylmethacrylic acid), poly(vinyl chloride), poly(methacrylic acid), copoly(styrene-maleic acid anhydride), copoly(styrene-acrylonitrile), copoly(styrene-butadiene), poly(vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic polymers, and hydrophobic transparent binders are preferred. Preferred binders include polyvinyl butyral, cellulose acetate, cellulose acetatebutyrate, polyeaster, polycarbonate, polyacrylic acid and polyurethane. Specifically preferred are polyvinyl butyral, cellulose acetate, cellulose acetatebutyrate, and polyester.

Another preferred binder is a polymeric latex. The polymeric latex is contained preferably in the image forming layer. The polymeric latex is contained in an amount of not less than 50% by weight, based on the total binder. Herein, the polymeric latex is a water-insoluble polymeric material which is dispersed in an aqueous dispersing medium in the form of fine particles. The dispersion form thereof may be any one of a form in which a polymer is emulsified in a dispersing medium, a form of being emulsion-polymerized, being dispersed in the form of a micell and a form in which a polymer has a hydrophilic partial structure and its molecular chain is in the form of a molecular dispersion. The polymeric latexes are described in "Synthetic Resin Emulsion" (edited by T. Okuda and h. Inagaki, published by KOBUNSHI-KANKOKAI, 1978), "Application of Synthetic Latex" (edited by Sugimura et al., published by KOBUNSHI-KANKOKAI, 1993), and "Chemistry of Synthetic Latex" (S. Muroi, published by KOBUNSHI-KANKOKAI, 1970).

The mean particle size of dispersing particles is 1 to 50,000 nm, and preferably 5 to 1,000 nm. The particle size distribution thereof is not specifically limited and may be polydisperse or monodisperse. The polymeric latexes used in the invention may be those having a uniform structure as well as core/shell type latexes. In this case, it is sometimes preferred that the glass transition temperature is different between the core and shell. The minimum forming (or tarnishing) temperature (MFT) of the polymeric latexes is preferably 30 to 90° C., and more preferably 0 to 70° C. A tarnishing aid is also called a plasticizer, which is an organic compound (conventionally, an organic solvent) capable of lowering the MFT of a polymeric latex and described in "Chemistry of Synthetic Latex" (S. Muroi, published by KOBUNSHI-KANKOKAI, 1970).

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1000,000, and more preferably 10,000 to 100,000. In cases where the molecular weight is excessively small, mechanical strength of an image forming layer such as a light-sensitive layer is insufficient, excessively large molecular weight results in deterioration in film forming property.

Exemplary examples of polymeric latexes used as binder include a latex of methylmethacrylate/ethylmethacrylate/methacrylic acid copolymer, a latex of methylmethacrylate/2-ethylhexylacrylate/styrene/acrylic acid copolymer, a latex of styrene/butadiene/acrylic acid copolymer, a latex of styrene/butadiene/divinylbenzene/methacrylic acid copolymer, a latex of methylmethacrylate/vinyl chloride/acrylic acid copolymer, and a latex of vinylidene chloride/ethylacrylate/acrylonitrile/methacrylic acid copolymer. Such polymers are commercially available, and examples of commercially available acryl resin include Sevian A-4635, 46583, and 4601 (available from DAISEL CHEMICAL INd. Ltd.)Nipol Lx811, 814, 821, 820, and 857 (available from NIHON ZEON Co. Ltd. Examples of polyester rein include FINETEX ES650, 611, 675, 850 (available from DAINIP- PON INK CHEMICAL Co. Ltd.), and WD-size WMS (available from Eastman Kodak Corp.). Examples of polyurethane resin include HYDRAN AP10, 20, 30, 40 (available from DAINIPPON INK CHEMICAL Co. Ltd.). Examples of rubber resin include LACSTAR 7310K, 3307, 4700H, 7132C (available from DAINIPPON INK CHEMICAL Co. Ltd.); and Nipol Lx416, 410, 438C and 2507 (available from NIHON ZEON Co. Ltd.). Examples of vinylidene chloride resin include L502, L513 (available from ASAHI CHEMICAL IND. Co. Ltd.). Examples of olefin resin include CHEMIPAL s120, SA100 (available from MITSUI PETROLEUM CHEMICAL IND. Co. Ltd.). These polymers can be used alone or may be blended.

Polymer species of the polymeric latex are preferably those containing 0.1 to 10% by weight of a carboxylic acid component, such as acrylate or methacrylate. In cases where a polymeric latex is incorporated in the image forming layer, the polymeric latex preferably accounts for at least 50% by weight, and more preferably at least 70% by weight, based on the binder contained in the image forming layer. In that case, not more than 50% by weight of the whole binder of the image forming layer may be accounted for by a hydrophilic polymer such as gelatin polyvinyl alcohol, methyl cellulose, hydroxypropyl cellulose, carboxymethyl cellulose, or hydroxypropykmethyl cellulose. The amount of these polymers is preferably not more than 30% by weight of the whole binder.

In case when the polymer latex is used in the image forming layer, it is preferred that an aqueous-type coating solution is coated and dried to form the image forming layer. Herein, the expression "aqueous-type" means that at least 50% (preferably at least 65%) by weight of a solvent (dispersing medium) used in the coating solution is water. The solvent(s) contained in the coating solution other than water include, for example, water-miscible organic solvents, such as methanol, ethanol, isopropanol, methyl cellosolve, ethyl cellosolve, dimethyl formamide and ethyl acetate. Examples of the solvent composition include water/methanol (90/10), water/methanol (70/30), water/ethanol (90/10), water/isopropanol (90/10), water/dimethyl formamide (95/5), water/methanol/dimethyl formamide (80/15/5), and water/methanol/dimethyl formamide (90/5/5), wherein the number means weight percentage.

There may be incorporated to the image forming layer a cross-linking agent for cross-linking or a surfactant to improve coating property. In cases when the image forming layer contains a polymeric latex, the coating solution of the image forming layer is preferably a thixotropy fluid. Herein the thixotropy indicates a property in which the viscosity is lowered with increasing the shear rate. The viscosity can be measured by any instrument, and preferably using FRS Fluid Spectrometer (available from Rheometrics Far East Corp.), at a temperature of 25° C. In a fluid containing an organic silver salt or a coating solution of the image forming layer used in this invention, the viscosity is preferably 400 mPa·s 100,000 mPa·s, and more preferably 500 mPa·s to 20,000 mPa·s at a shear rate of 0.1/sec. Further, the viscosity is preferably 1 mPa·s 200 mPa·s, and more preferably 5 mPa·s to 80 mPa·s at a shear rate of 1,000/sec. There are known various systems exhibiting thixotropy, as described in "Series Rheology" edited by KOBUNSHI-KANKOKAI; and "Polymer Latex" (Muroi & Morino, published by KOBUNSHI-KANKOKAI). To allow the liquid to display thixotropy, it is necessary to contain a large amount of fine solid particles. Further, incorporation of a viscosity-increasing linear polymer, the fine solid particles exhibiting anisotropy and having a large aspect ratio, viscosity increasing with alkali or the use of a surfactant is also-effective to enhance the thixotropy.

The total amount of the binder used in the image forming layer is 0.2 to 30 g/m2, and preferably 1 to 15 g/m$^2$. There can be provided a non-image forming layer on the outer side of the image forming layer to protect the surface of the photothermographic material or prevent it from abrasion. Binders used in the light-insensitive layer may be the same with or different from those used in the image forming layer. The binder amount in the image forming layer is preferably 0.5 to 30 g/m$^2$, and more preferably 1 to 15 g/m$^2$ to enhance thermal developing speed. In the case of less than 0.5 g/m2, the density of unexposed areas sometimes markedly increases to a level unacceptable to practical use.

It is preferred to incorporate a matting agent to the image forming layer-side. Thus, it is preferred to allow a matting agent to exist on the surface of the photothermographic material to prevent images formed after thermal processing from abrasion. The amount of the matting agent is preferably 0.5 to 30% by weight, based on the whole binder of the image forming layer-side. In cases where at least a non-image forming layer is provided on the side opposite to the image forming layer, the non-image forming layer preferably contains a matting agent. The matting agent may be either regular form or irregular form, and preferably is a regular form and a spherical form is more preferred.

In the photothermographic material used in this invention, there may be provided, on a support, an image forming layer alone, but at least a non-image forming layer is preferably provided on the image forming layer. To control the amount or wavelength distribution of light passing through the image forming layer, there may be a filter dye layer on the image forming layer-side or an atihalation dye layer, so-called backing layer on the opposite side. A dye or pigment may be incorporated to the image forming layer. The non-image forming layer may contain the binder or matting agent described above, or lubricants such as a polysiloxane compound or liquid paraffin.

Various types of surfactants can be employed as a coating aid in the photothermographic material used in this invention. Specifically, fluorinated surfactants are preferably employed to improve an antistatic property or to prevent dot-like coating troubles.

An anti-halation layer is provided farther from the image forming layer with respect to a light source. The anti-halation layer preferably exhibits the maximum absorption of 0.1 to 2.0 within the intended wavelength region, and more preferably 0.2 to 1.5 of the absorption within the exposure wavelength region; the absorption after being processed is preferably not less than 0.01 and less than 0.2, and more preferably not less than 0.001 and less than 0.15, as a optical density of the layer. In cases where used in printing plate making, the layer exhibits preferably an optical density of not less than 0.001 and less than 0.2, and more preferably not less than 0.001 and less than 0.15 in the absorption at a wavelength of 400 nm. Anti-halation dyes usable in this invention are any compound having desired absorption within the intended wavelength region and exhibiting sufficiently reduced absorption after being processed, thereby forming a desired absorption spectrum form.

Examples of the dyes include compounds described in JP-A 59-56458, 2-216140, 7-13295, 7-11432; U.S. Pat. No. 5,380,635; JP-A 2-6853 at page 13, lower left column line 1 to page 14, lower left column line 9, JP-A 3-24539 at page 14, lower left column to page 16, lower right column. Dyes capable of being decolored on processing include, for example, compounds described in JP-A 52-139136, 53-132334, 56-501480, 57-16060, 57-68831, 57-101835, 59-182436, 7-36145, 7-199409; JP-B (hereinafter, the term, JP-B means published Japanese Patent) 48-33692, 5-16648, 2-41734; and U.S. Pat. Nos. 4,088,497, 4,283,487, 4,548, 896, and 5,187,049.

The photothermographic material used in this invention is preferably a single-sided recording material comprising on one side of the support having at least an image forming layer and a back layer on the other side. Binders suited to the back layer are transparent or translucent and, in general, colorless, including natural polymers, synthetic resin and polymers, and their copolymers. Examples thereof include gelatinarabic gum, poly(vinyl alcohol), hydroxyethyl cellulose, cellulose acetate, cellulose butylate, poly(vinyl pyrrolidine), casein, starch, poly(acrylic acid), poly(methyl methacrylic aicd), poly(vinyl chloride), poly(methacrylic acid), copoly(styrene-anhydrous maleic acid), copoly (styrene-acrylonitrile), copoly(styrene-butadiene), poly (vinyl acetal)s such as poly(vinyl formal), poly(vinyl butyral), polyesters, polyurethanes, phenoxy resin, poly (vinilidene chloride), polyexpoxides, polycarbonates, poly (vinyl acetate), cellulose esters, and polyamides. Binders may be cover-coated using water, an organic solvent or an emulsion.

The back layer preferably exhibits the maximum absorption of 0.3 to 2. 0 within the intended wavelength region, and more preferably 0.5 to 2 of the absorption within the exposure wavelength region; the absorption after being processed is preferably not less than 0.01 and less than 0.5, and more preferably not less than 0.001 and less than 0.3, as a optical density of the layer. In cases where used in printing plate making, the layer exhibits preferably an optical density of not less than 0.001 and less than 0.2, and more preferably not less than 0.001 and less than 0.15 in the absorption at a wavelength of 400 nm. Examples of anti-halation dyes used in the back layer are the same as cited in the anti-halation layer afore-mentioned.

Various additives may be incorporated to any one of the image forming layer, non-image forming layer and other layers. There may be employed a surfactant, antioxidant, stabilizer, plasticizer, UV absorbent, and coating aid in the photothermographic material. As these additives and other adjuvants are usable compounds described in Research Disclosure (also denoted as RD) 17029 (June, 1978, pages 9–15).

Supports usable in this invention are preferably plastic films to prevent deformation after being processed, including, e.g., polyethylene terephthalate (PET), polycarbonate, polyimide, nylon, cellulose acetate, and polyethylene naphthalate. The thickness of a support is ca. 50 to 300 $\mu$m, and preferably 70 to 180 $\mu$m. There may be used a thermally treated plastic resin support. The thermal treatment of the support is to heat at a temperature of at least 30° C., preferably at least 35° C., more preferably at least 40° C. higher than the glass transition point of the support, after casting of the film and until coating of the image forming layer. Casting and subbing of the -support can be made by commonly known methods and preferably according to the method described in JP-A 8-50094 at paragraphs [0030] to [0070].

Photothermographic materials may be developed by any method, and the imagewise-exposed photothermographic material is usually heated to be developed. The heat-developing time is preferably 105 to 145° C., and more preferably 107 to 140° C. The heat-developing time is preferably 1 to 180 sec., more preferably 7 to 50 sec., and still more preferably 8 to 25 sec. The photothermographic materials are thermally processed preferably using a thermal processor. The photothermographic material is easily affected by the temperature variation of the heat-developing section of the processor, resulting in uneven development. There are employed a heated drum type automatic processor described in JP-A 9-297384, 9-297385 and 9-297386, and a planar-transport type automatic thermal processor described in WO 98/27458. Photothermographic materials specifically used in the field of printing plate making are preferably processed by the planer-transport type thermal processor to enhance dimensional stability. A thermal processor is preferably used, in which a pre-heating section is provided prior to the heat-developing section and the preheating temperature is 80 to 120° C. The pre-heating promotes development and reduces unevenness in density, and also being effective in scanning unevenness. A thermal processor described in JP-A 11-133572 is also preferably used, in which a photothermographic material is transported while one side of the photothermographic material is brought into contact with a fixed hating body and the other side is pressed to a heating body by plural rollers.

Photothermographic materials used in this invention may be exposed by any means and lasers are preferably employed as a light source. Preferred lasers usable in this invention include, for example, gas laser, YAG laser, dye laser and semiconductor laser. Specifically, longitudinal multiple exposure or an oblique exposure method is preferred to prevent interference fringes and unevenness of halftone dot exposure.

The longitudinal multiple exposure is made using a laser scanning exposure apparatus emitting longitudinally multiple scanning laser light beams, whereby deterioration in image quality such as occurrence of interference fringe-like unevenness is reduced, as compared to a scanning laser beam of the longitudinally single mode. As described in JP-A 59-10964, longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm. The oblique exposure is that exposure is made using a laser exposure apparatus, in which a scanning laser light is not exposed at an angle substantially vertical to the exposed surface of the photothermographic material, as described in JP-A 5-113548. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photosensitive material is scanned with laser light, the beam spot diameter on the surface of the photosensitive material is preferably not more than 200 $\mu$m, and more preferably not more than 100 $\mu$m. Thus, a smaller spot diameter preferably reduces the angle displacing from verticality of the laser incident angle.

EXAMPLES

Embodiments of the present invention will be further described based on examples, but the invention is not limited to these.

Example 1

Preparation of Photothermographic Material

Preparation of a Subbed Photographic Support

Both surfaces of a biaxially stretched thermally fixed 125 $\mu$m polyethylene terephthalate (hereinafter, also denoted as PET) film, available on the market, were subjected to corona discharging at 8 w/m$^2$.min. Onto the surface of one side, the subbing coating composition a-1 descried below was applied so as to form a dried layer thickness of 0.8 $\mu$m, which was then dried. The resulting coating was designated Subbing Layer A-1. Onto the opposite surface, the subbing coating composition b-1 described below was applied to form a dried layer thickness of 0.8 $\mu$m. The resulting coating was designated Subbing Layer B-1. Subbing Coating Composition a-1

| | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis (ethyleneurea) | 0.8 g |
| Polystyrene fine particles (av. size, 3 $\mu$m) | 0.05 g |
| Colloidal silica (av. particle size, 90 $\mu$m) | 0.1 g |
| Water to make | 1 liter |

Subbing Coating Composition b-1

| | |
|---|---|
| $SnO_2$/Sb (9/1 by weight, av. Size 0.18 $\mu$m) | 200 mg/m$^2$ |
| Latex liquid (solid portion of 30%) of a copolymer consisting of butyl acrylate (30 weight %) styrene (20 weight %) glycidyl acrylate (40 weight %) | 270 g |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 w/m$^2$.minute. Onto the Subbing Layer A-1, the upper subbing layer coating composition a-2 described below was applied so as to form a dried layer thickness of 0.1 $\mu$m, which was designated Subbing Layer A-2, while onto the Subbing Layer B-1, the upper subbing layer coating composition b-2 was applied so at to form a dried layer thickness of 0.8 $\mu$m, having a static preventing function, which was designated Subbing Upper Layer B-2.

Upper Subbing Layer Coating Composition a-2

| | |
|---|---|
| Gelatin in an amount (weight) to make 0.4 g/m$^2$ | |
| (C-1) | 0.2 g |
| (C-2) | 0.2 g |
| (C-3) | 0.1 g |
| Silica particles (av. size 3 $\mu$m) | 0.1 g |
| Water to make | 1 liter |

Upper Subbing Layer Coating Composition b-2

| | |
|---|---|
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

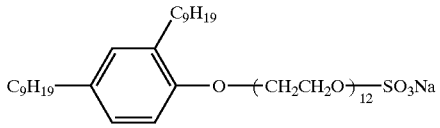

(C-2)

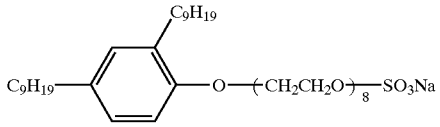

(C-3)

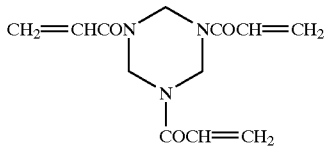

(C-4)

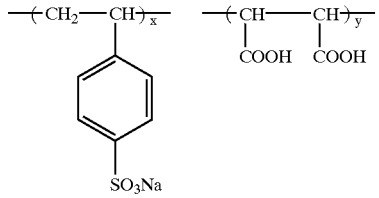

$\overline{M}_n$ = 5000

($\overline{M}$n is a number average molecular weight)
x:y = 75:25 (weight ratio)

(C-5)

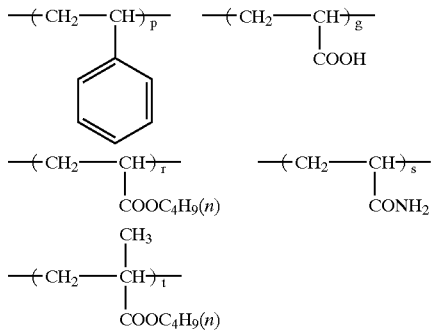

p:g:r:s:t = 40:5:10:5:40 (weight ratio)

(C-6)

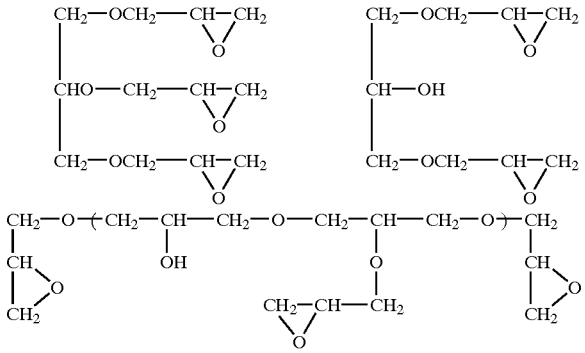

Mixture consisting of the three compounds illustrated above

Thermal Treatment of Support

In the subbing and drying process of the subbed support, the support was heated at 140° C. and then gradually cooled. The support was winded at a tension of 2 kg/cm$^2$.

Preparation of Silver Halide Emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide, $1\times10^{-6}$ mol/mol Ag of [Ir(NO)$Cl_5$] and $1\times10^{-6}$ mol/mol Ag of rhodium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 45%, and the proportion of the {100} face of 87%. The resulting emulsion was flocculated to remove soluble salts, employing a flocculating agent and after desalting, 0.1 g of phenoxyethanol was added and the pH and pAg were adjusted to 5.9 and 7.5, respectively. The emulsion was chemically sensitized with chloroauric acid, inorganic sulfur, thiourea dioxide and 2,3,4,56-pentafluorophenyldiphenylphosphine selenide to obtain silver halide emulsion A.

Preparation of Sodium Behenate Solution

In 945 ml water were dissolved 32.4 g of behenic acid, 9.9 g of arachidic acid and 5.6 g of stearic acid at 90° C. Then, after adding 98 ml of 1.5M aqueous sodium hydroxide solution with stirring and further adding 0.93 ml of concentrated nitric acid, the solution was cooled to a temperature of 55° C. and stirred for 30 min. to obtain an aqueous sodium behenate solution.

Preparation of Pre-formed Emulsion of Silver Behenate and Silver Halide Emulsion To the aqueous sodium behenate solution described above was added 15.1 g of silver halide emulsion A. After adjusting the pH to 8.1 with aqueous sodium hydroxide, 147 ml of aqueous 1M silver nitrate solution was added thereto in 7 min and after stirring for 20 min., soluble salts were removed by ultrafiltration. Thus obtained silver behenate was comprised of monodisperse needle-like particles having an average long edge length of 0.8 μm. After forming flock of the dispersion, water was removed therefrom and then, washing and removal of water were repeated six times and finally, drying was conducted.

Preparation of Light-sensitive Emulsion containing Organic Silver Salt A

To a half of the thus prepared pre-formed emulsion were gradually added 544 g of methyl ethyl ketone solution of 17 wt % polyvinyl butyral (average molecular weight of 3,000) and 107 g of toluene. Further, the mixture was dispersed at 4,000 psi. After dispersion, organic silver salt particles were observed with an electron microscope. The silver salt was comprised of non-monodisperse particles having an average particle size was 0.7 μm and a dispersion degree of 60%. From electronmicroscopic observation of the organic silver salt after completion of coating and drying, it was confirmed that the silver salt was comprised of the same particles.

Preparation of Silver Halide Emulsion B

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide, $1\times10^{-6}$ mol/mol Ag of [Ir(NO)$Cl_5$] and $1\times10^{-6}$ mol/mol Ag of rhodium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 12%, and the proportion of the {100} face of 49%. The resulting emulsion was flocculated to remove soluble salts, employing a flocculating agent and after desalting, 0.1 g of phenoxyethanol was added and the pH and pAg were adjusted to 5.9 and 7.5, respectively. The emulsion was chemically sensitized with chloroauric aicd, inorganic sulfur, thiourea dioxide and 2,3,4,56-pentafluorophenyldiphenylphosphine selenide to obtain silver halide emulsion B.

Preparation of Sodium Behenate Solution

In 945 ml water were dissolved 32.4 g of behenic acid, 9.9 g of arachidic acid and 5.6 g of stearic acid at 90° C. Then, after adding 98 ml of 1.5M aqueous sodium hydroxide solution with stirring and further adding 0.93 ml of concentrated nitric acid, the solution was cooled to a temperature of 55° C. and stirred for 30 min. to obtain an aqueous sodium behenate solution.

Preparation of Pre-formed Emulsion of Silver Behenate and Silver Halide Emulsion To the aqueous sodium behenate solution obtained above was added 15.1 g of silver halide emulsion B. After adjusting the pH to 8.1 with aqueous sodium hydroxide, 147 ml of aqueous 1M silver nitrate solution was added thereto in 7 min and after stirring for 20 min., soluble salts were removed by ultrafiltration. Thus obtained silver behenate was comprised of monodisperse needle-like particles having an average long edge length of 0.8 μm. After forming flock of the dispersion, water was removed therefrom, then, washing and removal of water were repeated six times and finally, drying was conducted.

Preparation of Light-sensitive Emulsion Containing Organic Silver Salt B

To a half of the thus prepared pre-formed emulsion were gradually added 544 g of methyl ethyl ketone solution of 17 wt % polyvinyl butyral (average molecular weight of 3,000) and 107 g of toluene. Further, the mixture was dispersed at 4,000 psi. After completing dispersion, the resulting organic silver salt particles were observed through electronmicrograph. As a result of measuring 300 particles with respect to particle diameter and thickness, 205 particles exhibited an aspect ratio (AR) of 3 or more and the organic silver salt was comprised of monodisperse tabular particles having a dispersion degree of 25% and an average diameter of 0.7 μm.

From electronmicroscopic observation of the organic silver salt after completion of coating and drying, it was confirmed that the silver salt was comprised of the same particles.

Back Coating

On the B-2 layer-side of the support which was subjected to an antistatic treatment, the following composition was coated using an extrusion coater so as to have a wet thickness of 30 $\mu$m and dried at 60° C. for 15 min.

| | |
|---|---|
| Cellulose acetate-butylate (10% methyl ethyl ketone solution) | 15 ml/m$^2$ |
| Dye-A | 7 mg/m$^2$ |
| Dye-B | 7 mg/m$^2$ |
| Matting agent: monodisperse silica (having a monodisperse degree of 15% and average size of 8 $\mu$m) | 15 mg/m$^2$ |
| Fluorinated surfactant $C_{12}F_{25}(CH_2CH_2O)_{10}C_{12}H_{25}$ | 10 mg/m$^2$ |

Dye-A

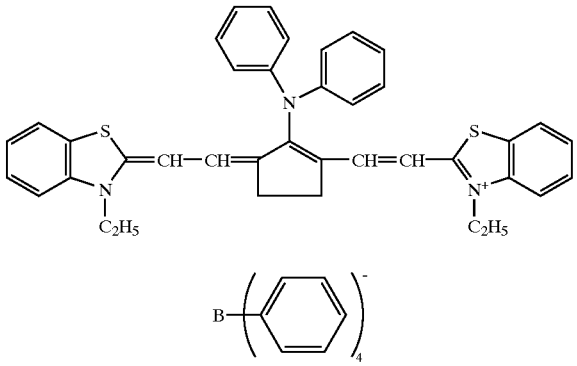

Dye-B

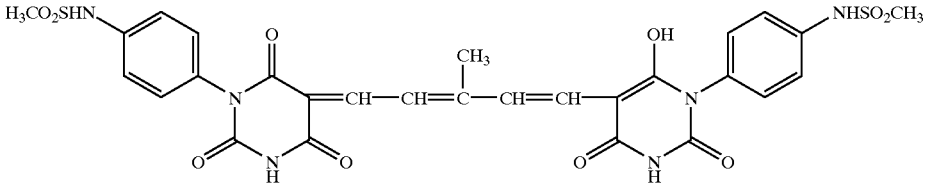

Coating of the Image-forming Layer Side

On the sub-layer A-2 side of the support, an image forming layer having the following composition was coated by an extrusion coater so that the silver coverage was 1.5 g/m$^2$. Sample 101 was dried at 65° .C for 1 min. and Sample 102 was dried at 55° C. for 15 min. On Sample 101 was further coated a protective layer coating solution 1, and on Sample 102 was coated a protective layer coating solution 2.

Image Forming Layer Coating Solution

| | |
|---|---|
| Light-sensitive emulsion | 240 g |
| Sensitizing dye (0.1% methanol solution) | 1.7 ml |
| Pyridinium bromide perbromide (6% methanol solution) | 3 ml |
| Calcium bromide (0.1% methanol solution) | 1.7 ml |
| Hexamethylenediisocyanate (10% methanol solution) | 1.2 ml |
| 2-(4-Chlorobenzoyl)-benzoic acid (12% methanol solution) | 9.2 ml |
| 2-Mercaptobenzimidazole (1% methanol solution) | 11 ml |
| Vinyl compound 1-8 | 0.5 g |
| Hydrazine derivative H-1-5 | 0.4 g |
| Quaternary onium compound P-45 | 0.1 g |
| O-69 | 0.4 g |
| A-3 (20% methanol solution) | 29.5 ml |
| Isocyanate compound (desmodur N3300) | 0.5 g |
| Phthalazinone | 0.2 g |
| 4-Methylphthalic acid | 0.25 g |
| Tetrachlorophthalic acid | 0.2 g |

Surface Protective Layer Coating Solution 1

| | |
|---|---|
| Acetone | 5 ml/m$^2$ |
| Methyl ethyl ketone | 21 ml/m$^2$ |
| Cellulose acetate | 2.3 g/m$^2$ |
| Methanol | 7 ml/m$^2$ |
| Phthalazinone | 250 mg/m$^2$ |
| Matting agent, monodisperse silica having a mean size of 4 $\mu$m | 10 mg/m$^2$ |
| Vinylsulfon compound VS-1 | 35 mg/m$^2$ |
| Surfactant $C_{12}F_{25}(CH_2CH_2O)_{10}C_{12}F_{25}$ | 10 mg/m$^2$ |

Surface Protective Layer Coating Solution 2

| | |
|---|---|
| Acetone | 5 ml/m$^2$ |
| Methyl ethyl ketone | 21 ml/m$^2$ |
| Cellulose acetate | 2.3 g/m$^2$ |

-continued

| | |
|---|---|
| Methanol | 7 ml/m$^2$ |
| Phthalazinone | 250 mg/m$^2$ |
| Matting agent, monodisperse silica having a mean size of 4 $\mu$m | 10 mg/m$^2$ |
| Vinylsulfon compound VS-1 | 35 mg/m$^2$ |
| Surfactant $C_{12}F_{25}(CH_2CH_2O)_{10}C_{12}F_{25}$ | 10 mg/m$^2$ |
| $C_8F_{17}$—$C_6H_4$—$SO_3Na$ | 10 mg/m$^2$ |

Sensitizing Dye

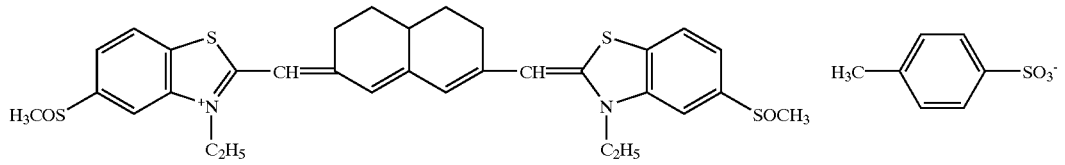

Vinylsulfone Compound VS-1

$CH_2{=}CHSO_2CH_2CH_2OCH_2CH_2SO_2CH{=}CH_2$

Sample 101 and 102 were thus obtained, as shown in Table 1. The amount of solvent methyl ethyl ketone (MEK) remaining in each sample was 70 mg/m$^2$. The Vickers hardness of the surface of the image forming layer-side of Sample 102 was 100; on the other hand, the Vickers hardness of the surface of the image forming layer-side of Sample 101 was 32. The equilibrium moisture content was determined according to the following procedure. After allowed to stand in an atmosphere of 25° C. and 60% RH for 24 hrs., each sample film was cut to a size of 46.3 cm$^2$. After weighing, it was shredded to ca. 5 mm pieces and put into a vial; and after sealing with septum and aluminum cap, it was set into Head Space Sampler HP7694 (available from Hewlett Packard Corp.). After heating the Head Space Sampler at 120° C. for 20 min., the evaporated moisture was determined according to the Karl Fischer's method. The equilibrium moisture contents of Samples 101 and 102 were 6% and 0.7%, respectively. Determination of Sensitivity variation (Sm)

Samples each were divided to two groups, one of them was allowed to stand under the condition at 23° C. and 50% RH for a period of 3 days, and the other one was allowed to stand in an incubator at a high temperature of 55° C. and a high humidity of 80% RH for a period of 3 days. Thereafter, the image forming layer-side of each of the thus aged samples was exposed through an optical wedge to laser using an exposure apparatus having a light source in which a 780 nm semiconductor laser was made to longitudinally multiple mode using the high frequency superimposing method. Exposed samples were each thermally processed at 120° C. for 20 sec. using thermal processor for dry film used in printing plate-making, Dry View Processor 2771 available from Kodak Polychrome Graphics Corp. This processor was a plane-transport type thermal processor having a pre-heating section at 110° C., in which the total time of from the time the top of a sample entered the processor to the time it came out was 48 sec. The thus processed samples were each subjected to densitometry to determine sensitivity. The sensitivity was represented by a logarithm of a reciprocal of exposure giving a density of 2.5. The sensitivity of a sample aged at 23° C. for 3 days was denoted as $S_o$, the sensitivity of a sample aged in the incubator at a high temperature of 55° C. and a high humidity of 80% RH was denoted as $S_1$ and the sensitivity variation (Sm) was determined according to the general formula defined in the requirement (1) afore-mentioned.

Transport Test

100 Sheets of each sample were continuously processed in the manner as described above and transport troubles were counted, based on sheet number.

Density Variation after Processing

Processed samples were each divided to two groups and one of them was aged in an incubator at 40° C. and 60% RH for 5 days, while being exposed to light. The density variation after being aged with respect to the density of 3.5 before being aged was measured by a densitometer.

Variation in Performance with Change of Thermal Processing Condition

Photothermographic material samples were exposed and processed at 115° C. for 20 sec. using a processor having a modified heat developing section. Sensitivity variation of each of processed samples was represented by a relative value as percentage, based on the sensitivity of a sample processed at 120° C. for 20 sec being 100% (and denoted as temperature dependence $S_T$).

Evaluation results are shown in Table 1.

TABLE 1

| Sample | Silver Halide Emulsion | Organic Silver Salt | Protective Layer Solution | Sensitivity Variation (Sm) | Transport Test | Density Variation | Temp. Dependence ($S_T$) | Remarks |
|---|---|---|---|---|---|---|---|---|
| 101 | A | A | 1 | −25 | 6 | 0.95 | 20 | Comp. |
| 102 | B | B | 2 | 5 | 0 | 0.05 | 85 | Inv. |

As can be seen from Table 1, the inventive sample was proved to be superior to the comparative sample.

Example 2

Preparation of Silver Halide Emulsion C

In 700 ml of water were dissolved 22 g of phthalated gelatin and 30 mg of potassium bromide. After adjusting the temperature and the pH to 40° C. and 5.0, respectively, 159 ml of an aqueous solution containing 18.6 g silver nitrate and 159 ml of an aqueous equimolar potassium bromide solution were added by the controlled double jet addition in 10 min. Then, an aqueous silver nitrate solution and an aqueous solution containing $8\times10^{-6}$ mol/l of $K_3[IrCl_6]$ and 1 mol/l of potassium bromide were added by the double jet addition in 15 min. Thereafter, the pH and pAg were adjusted to 5.9 and 8.0, respectively. There were obtained non-monodisperse, cubic silver halide grains having an average grain size of 0.08 μm, a variation coefficient of the projection area equivalent diameter of 45%, and the proportion of the {100} face of 40%.

The thus obtained silver halide grain emulsion was heated to 60° C. and ripened with $8.5\times10^{-5}$ mol of sodium thiosulfate, $1.1\times10^{-5}$ mol of 2,3,4,5,6-pentafluorophenyldiphenyl-phosphine selenide, $1\times10^{-6}$ mol of tellurium compound-1 and $3.3\times10^{-6}$ mol of chloroauric acid and $2.3\times10^{-4}$ mol thiocyanic acid, each per mol of silver. Thereafter, the temperature was lowered to 50° C., then, $8\times10^{-4}$ mol/mol Ag of sensitizing dye C was added thereto with stirring. Subsequently was added thereto potassium iodide of $3.5\times10^{-2}$ mol, based on silver and after stirring for 30 min., the emulsion was cooled to 30° C. to obtain silver halide grain emulsion C.

Tellurium compound-1

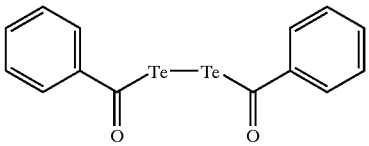

Sensitizing dye C

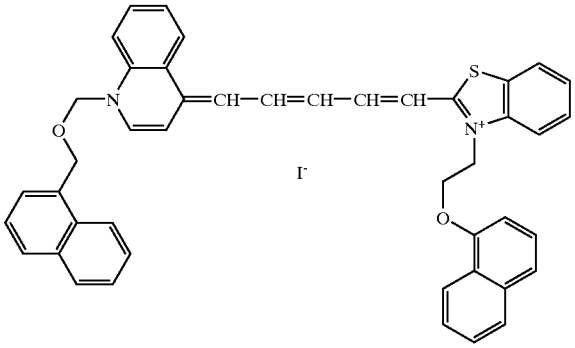

Preparation of Organic Silver Salt Microcrystal Dispersion C

Behenic acid of 40 g, stearic acid of 7.3 g were stirred with 500 ml water at 90° C. for 15 min. and 187 ml of an aqueous 1N sodium hydroxide solution was added thereto in 15 min., then, 61 ml of an aqueous 1N silver nitrate solution was further added, and the temperature was lowered to 50° C. Subsequently, 124 ml of an aqueous 1N silver nitrate solution was added thereto and further stirred for 5 min. The solid product was filtered using a suction funnel and then subjected to water washing until the conductivity of the filtrate reached 30 μS/cm. The thus obtained solid was treated in a wet cake form, without being dried. To the wet cake equivalent to 34.8 g of dried solid, 120 g of polyvinyl alcohol and 150 ml water were added with stirring to form slurry. The slurry was added into a vessel together with 840 g of zirconia beads having an average diameter of 0.5 mm and dispersed for 5 hrs. by a dispersing machine (1/4 Sand Grinder Mill, available from IMEX Co. Ltd.) in 30 min. to obtain an organic silver salt microcrystal dispersion, which was comprised of non-monodisperse organic silver salt microcrystals exhibiting a volume-averaged size of 1.6 μm and a dispersion degree of 55%. The particle size was measured using Master Saizer X, available from Malvern Instrument Co., Ltd.

Preparation of Silver Halide Emulsion D

In 700 ml of water were dissolved 22 g of phthalated gelatin and 30 mg of potassium bromide. After adjusting the temperature and the pH to 40° C. and 5. 0, respectively, 159 ml of an aqueous solution containing 18.6 g silver nitrate and 159 ml of an aqueous equimolar potassium bromide solution were added by the controlled double jet addition in 10 min, while the pAg was maintained at 7.7. Then, an aqueous silver nitrate solution and an aqueous solution containing $8\times10^{-6}$ mol/l of $K_3[IrCl_6]$ and 1 mol/l of potassium bromide were added by the double jet addition in 30 min, while the pAg was maintained at 7.7. Thereafter, the pH and pAg were adjusted to 5.9 and 8.0, respectively. There were obtained monodisperse, cubic silver halide grains having an average grain size of 0.07 μm, a dispersion degree of 15%, and the proportion of the {100} face of 85%. The thus obtained silver halide grain emulsion was heated to 60° C. and ripened in 120 min. by adding $8.5\times10^{-5}$ mol of sodium thiosulfate, $1.1\times10^{-5}$ mol of 2,3,4,5,6-pentafluorophenyldiphenyl-phosphine selenide, $1\times10^{-6}$ mol of tellurium compound-1 and $3.3\times10^{-6}$ mol of chloroauric acid and $2.3'10^{-4}$ mol thiocyanic acid, each per mol of silver. Thereafter, the temperature was lowered to 50° C., then, $8\times10^{-4}$ mol/mol Ag of sensitizing dye C was added thereto with stirring. Subsequently was added thereto potassium iodide of $3.5\times10^{-2}$ mol, based on silver and after stirring for 30 min., the emulsion was cooled to 30° C. to obtain silver halide grain emulsion D.

Preparation of Organic Silver Salt Microcrystal Dispersion D

Behenic acid of 40 g, stearic acid of 7.3 g were stirred with 500 ml water at 90° C. for 15 min. and 187 ml of an aqueous 1N sodium hydroxide solution was added thereto in 15 min., then, 61 ml of an aqueous 1N silver nitrate solution was further added, and the temperature was lowered to 50° C. Subsequently, 124 ml of an aqueous 1N silver nitrate solution was added thereto and further stirred for 30 min. The solid product was filtered using a suction funnel and then subjected to water washing until the conductivity of the filtrate reached 30 μS/cm. The thus obtained solid was treated in a wet cake form, without being dried. To the wet cake equivalent to 34.8 g of dried solid, 120 g of polyvinyl alcohol and 150 ml water were added with stirring to form slurry. The slurry was added into a vessel together with 840 g of zirconia beads having an average diameter of 0.5 mm and dispersed for 5 hrs. by a dispersing machine (1/4 Sand Grinder Mill, available from IMEX Co. Ltd.) in 30 min. to obtain an organic silver salt microcrystal dispersion D, which was comprised of non-monodisperse organic silver salt microcrystals exhibiting a volume-averaged size of 1.2 μm and a dispersion degree of 20%. The particle size was measured using Master Saizer X, available from Malvern Instrument Co., Ltd.

Preparation of Fine Solid Particle Dispersion of Materials

A fine solid particle dispersion of tetrachlorophthalic acid, 4-methylphthalic acid, 1,1-bis(2-hydroxy-3,5-dimethylphenyl)-3,5,5-trimethylhexane, phthalazine or tribromomethylsulfonylbenzene was prepared. Thus, to 5.4 g of tetrachlorophthalic acid were added 0.81 g f hydroxypropylcellulose and 94.2 ml water with stirring and was allowed to stand in the form of a slurry for 10 hrs. Thereafter, 100 ml of zircinia beads having an average diameter of 0.5 mm was added together with the slurry to the vessel and dispersed in 5 hrs. the same type dispersing apparatus as used in the preparation of the silver salt microcrystal dispersion to obtain a tetrachlorophthalic acid microcrytal dispersion, in which 70 wt % of the fine solid particles exhibited a size of 1.0 μm or less. With regard to other materials, solid particle dispersions were obtained in a similar manner, provided that the amount of a surfactant and the dispersing time were optimally varied to obtain an intended average particle size.

Image Forming Layer Coating Solution

To the thus prepared organic silver salt microcrystal dispersion were added the following additives to prepare a coating solution for an image forming layer.

| | |
|---|---|
| Organic silver salt microcrystal dispersion | 1 mole |
| Silver halide emulsion C | 0.05 mole |
| Binder: SBR latex (LACSTAR 3307B* available from DAINIPPON INK Co., Ltd) | 430 g |
| 1,1-Bis(2-hydroxy-3,5-dimethylphenyl)-3,5,5-trimethylhexane | 98 g |
| Phthalazine | 9.0 g |
| Tribromomethylphenylsulfone | 12 g |
| 4-Methylphthalic acid | 7 g |
| Vinyl compound 8-6 | 8 g |
| Hydrazine derivative | 5 g |

*LACSTAR 3307B is a latex of styrene-butadiene copolymer, the average dispersed particle size being 0.1 to 0.15 μm and the equilibrium moisture content of the polymer being 0.6% at 25° C. and 60% RH.

Surface Protective Layer Coating Solution 3

To inert gelatin, the following components were added to prepare a coating solution for a surface protective layer.

| | |
|---|---|
| Inert gelatin | 10 g |
| Surfactant A | 0.26 g |
| Surfactant B | 0.09 g |
| Fine silica particles (av. size 2.5 μm) | 0.1 g |
| 1,2-(Bisvinylsulfonamido)ethane | 0.1 g |
| Water | 65 g |

Surface Protective Layer Coating Solution 4

To inert gelatin, the following components were added to prepare a coating solution for a surface protective layer.

| | |
|---|---|
| Inert gelatin | 10 g |
| Surfactant A | 0.26 g |
| Surfactant B | 0.09 g |
| Fine silica particles (av. size 2.5 μm) | 0.9 g |
| Colloidal silica | 0.5 g |
| 1,2-(Bisvinylsulfonamido)ethane | 0.5 g |
| Water | 64 g |

Back Layer Coating Solution

To polyvinyl alcohol, the following components were added to prepare a coating solution for a back layer.

| | |
|---|---|
| Polyvinyl alcohol | 30 g |
| Dye C | 5 g |
| Water | 250 g |
| SILDEX H121 (spherical silica having average size of 12 μm, available from DOKAI KAGAKU Co., Ltd.) | 1.8 g |

Surfactant A

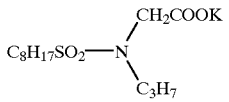

Surfactant B

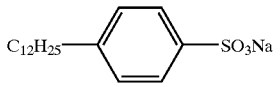

The thus prepared coating solution for the image forming layer was coated on a polyethylene terephthalate support so as to have a silver coverage of 1.6 g/m$^2$. Further thereon, the protective layer coating solutions 3 and 4 were coated to obtain Samples 201 and 202, respectively. Sample 201 was dried at a temperature of 55° C. for 1 min. and Sample 202 was dried at 65° C. for 20 min. After completion of drying, the coating solution for the back layer was coated on the opposite side of the support to the image forming layer so as to exhibit an optical density of 0.7 at 780 nm. Samples 201 and 202 were thus obtained, as shown in Table 2. The Vickers hardness of the surface of the image forming layer side was 110. Samples were each evaluated in the same manner as in Example 1 and the results thereof are shown in Table 2. Samples were each subjected to scanning exposure through an optical wedge using an exposure apparatus, in which exposure was made at an angle of 800 between a 780 nm semiconductor laser beam and the photothermographic material surface.

TABLE 2

| Sample | Silver Halide Emulsion | Organic Silver Salt | Protective Layer Solution | Sensitivity Variation (Sm) | Transport Test | Density Variation | Temp. Dependence ($S_T$) | Remarks |
|---|---|---|---|---|---|---|---|---|
| 201 | C | C | 3 | 35 | 12 | 1.1 | 10 | Comp. |
| 202 | D | D | 4 | 8 | 0 | 0.1 | 80 | Inv. |

As can be seen from Table 2, inventive Sample 202 exhibited superior results, as compared to comparative Sample 201.

Example 3

A subbed support was prepare according to the following manner.

Preparation of PET Support (1) Support Using terephthalic acid and ethylene glycol was obtained polyethylene terephthalate (PET) of IV=0.66 (which was measured at 25° C. in phenol/tetrachloroethylene=6/4 by weight). After being dried at 1300 C, PET pellets were melted at 300° C., extruded through T-type die and immediately thereafter cooled to prepare unstretched film. Using rolls different in circumferential speed, the film is longitudinally stretched to 3.3 times and then laterally stretched to 4.5 times by means of a tenter, in which the temperature was 110° C. and 130° C., respectively. Thereafter, the stretched film was thermally fixed at 240° C. for 20 sec. and then subjected to relaxation in the lateral direction to 4%. Then, after the portion corresponding to the tenter chuck section was slitted and both edge portions were subjected to a knurling treatment and winded at 4.8 kg/cm$^2$. There was thus obtained a 2.4 m width, 800 m long and 125 $\mu$m thick PET film.

(2) Sublayer (a)

| | |
|---|---|
| Polymer latex; styrene/butadiene/hydroxy ethylmethacrylate/divinylbenzene = 67/30/2.5/0.5 (by wt %) | 160 mg/m$^2$ |
| 2,4-Dichloro-6-hydroxy-s-triazine | 4 mg/m$^2$ |
| Matting agent (polystyrene, av. particle size of 2.4 $\mu$m) | 3 mg/m$^2$ |

Sublayer (b)

| | |
|---|---|
| Alkali-processed gelatin ($Ca^{++}$ content of 300 ppm, gelly strength of 230 g) | 50 mg/m$^2$ |

Compound C in an amount giving a density of 0.7 at 780 nm

Compound C

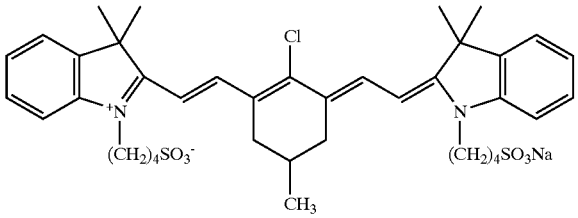

(3) Conductive Layer

| | |
|---|---|
| Julymer ET-410 (available from NIPPON JUNYAKU CO., Ltd.) | 38 mg/m$^2$ |
| Matting agent (polymethyl methacrylate av. particle size of 5 $\mu$m) | 7 mg/m$^2$ |
| Melamine | 13 mg/m$^2$ |

(4) Protective Layer

| | |
|---|---|
| Chemipearl S-120 (available from Mitsui Petrochemical Industries Ltd.) | 500 mg/m$^2$ |
| Snowtex-C (available from Nissan Chemical Industries Ltd.) | 40 mg/m$^2$ |
| Denacol EX-614B (available from Nagase Kasei Kogyo Co., Ltd.) | 30 mg/m$^2$ |

On both sides of the support, sublayer (a) and sublayer (b) were coated in this order and dried at 180° C. for 4 min. On one side thereof, the conductive layer and the protective layer were coated in this order to obtain a PET support provided with backing/subbing layers. The thus prepared PET support was entered into a heat-treatment zone of total length of 200 m and set to a temperature of 200° C. and transported at a tension of 3 kg/cm$^2$ and a transport speed of 20 m/min, then, was allowed to pass through a zone at 40° C. for 15 sec. and wound at a tension of 10 kg/cm$^2$. Preparation of Surface Protective Layer Coating Solution 5 To 500 g of a 40% polymer latex (copolymer of methyl methacrylate/styrene/2-ethylhexylacrylate/2-hydroxyethyl methacrylate/methacrylic acid=59/9/26/5/1), 262 g $H_2O$ was added, then, 14 g of benzyl alcohol as a film-making aid, 2.5 g of compound D, 2.5 g of Cellosol 524 (available from CHUKYO YUSHI Co. Ltd.), 12 g of compound E, 1 g of compound F, 2 g of compound G, 7.5 g of compound H and 0.5 g of fine polymethyl methacrylate particles of an average size of 3 $\mu$m, as a matting agent were successively added thereto and water was added to make the total amount of 1,000 g. There was thus obtained a coating solution exhibiting a viscosity of 5 cp (at 25° C.) and a pH of 4.5 (at 25° C.).

Compound D

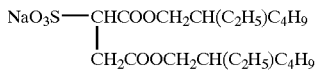

Compound E

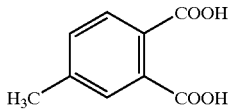

Compound F

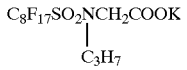

Compound G

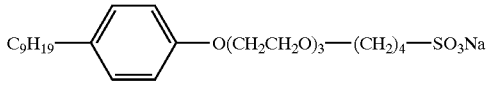

Compound H

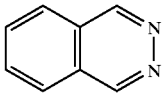

Preparation of Surface Protective Layer Coating Solution 6

To 500 g of a 40% polymer latex (copolymer of methyl methacrylate/styrene/2-ethylhexylacrylate/2-hydroxyethyl methacrylate/methacrylic acid=59/9/26/5/1), 262 g $H_2O$ was added, then, 14 g of benzyl alcohol as a film-making aid, 2.5 g of compound D, 2.5 g of Cellosol 524 (available from CHUKYO YUSHI Co. Ltd.), 12 g of compound E, 1 g of compound F, 2 g of compound G, 7.5 g of compound H, 3.4 g of fine polymethyl methacrylate particles of an average size of 3 $\mu$m, as a matting agent and 1 g of colloidal silica were successively added thereto and water was added to make the total amount of 1,000 g. There was thus obtained a coating solution exhibiting a viscosity of 5 cp (at 25° C.) and a pH of 3.4 (at 25° C.).

Preparation of Photothermographic Material

On the subbed/backed PET support, the image forming layer used in Example 2 was coated so as to have a silver coverage of 1.6 g/m$^2$. Further thereon, the protective layer coating solutions 5 and 6 were each coated so as to have a coating amount of 2.0 g/m$^2$ to obtain Samples 301 and 302, respectively. Samples were evaluated in the same manner as in Example 1. Results thereof are shown in Table 3.

TABLE 3

| Sample | Silver Halide Emulsion | Organic Silver Salt | Protective Layer Solution | Sensitivity Variation (Sm) | Transport Test | Density Variation | Temp. Dependence ($S_T$) | Remarks |
|---|---|---|---|---|---|---|---|---|
| 301 | C | C | 5 | 28 | 12 | 1.0 | 25 | Comp. |
| 302 | D | D | 6 | 10 | 0 | 0.15 | 85 | Inv |

As can be seen from Table 3, Sample 302 exhibited superior results, compared to Sample 301.

Example 4

Samples 101 and 102 used in Example 1 were processed similarly to Example 1, provided that an automatic thermal processor shown in FIG. 1 was employed. Results thereof are shown in Table 4.

As shown in FIG. 1, the processor is provided with plate heater 120 comprised of a flocked stainless steel plate as a heating body heated to a temperature necessary to process photothermographic material sheet A, transport means 126 for move (or slide) the sheet A relative to the plate heater 120, while the sheet is brought into contact with the plate heater 120, and pressing rollers 122 as a means for pressing the back side of the sheet A to the surface in contact with the plate heater 120. The plate heater is a planar plate heater. Thus, the plate heater 120 is a planar heating member to maintain the photothermographic material at a developing temperature, in which nichrome wires are internally installed in a planar form. The photothermographic material, after exposed, is introduced to processor 18 via supply roller pair 126 driven by a driving apparatus; then, the sheet A is allowed to pass through between the pressing rollers 122 of silicone rubber and plate heater 120 by driving transport of the supply roller pair 126 to be thermally processed therein, wherein 122*a* and 122*b* are the front and rear rollers, respectively. The thermally processed photothermographic material sheet A is discharged through paired discharge rollers 128. To prevent abrasion marks, the back-side of the photothermographic material sheet is brought into contact with the plate heater 120. The pressing rollers 122 are brought into contact with the other side thereof and arranged at a given pitch over a whole length of the plate heater 120 in the transporting direction, with spacing of less than the sheet thickness to form a sheet transport route 124 with the pressing rollers 122 and plate heater 120. On the both ends of the sheet transport route 124, a pair of supply rollers 126 and a pair of discharge rollers 128 are arranged as means for transporting the photothermographic material. These are covered with a heat-insulating cover 125.

TABLE 4

| Sample | Silver Halide Emulsion | Organic Silver Salt | Protective Layer Solution | Sensitivity Variation (Sm) | Transport Test | Density Variation | Temp. Dependence ($S_T$) | Remarks |
|---|---|---|---|---|---|---|---|---|
| 101 | A | A | 1 | −28 | 7 | 0.90 | 18 | Comp. |
| 102 | B | B | 2 | 4 | 0 | 0.04 | 80 | Inv. |

As can be seen from Table 4, Sample 102 exhibited superior results, compared to Sample 101.

EFFECT OF THE INVENTION

According to this invention, there could be provided a photothermographic material improved in transport property in processing in an automatic processor, fogging after being processed and stability in variation of processing conditions, and an image forming process by use thereof. Disclosed embodiment can be varied by a skilled person without departing from the spirit and scope of the invention.

What is claimed is:

1. A photothermographic material comprising a support, silver halide, an organic silver salt and a reducing agent, wherein the photothermographic material meets the following requirement (1):

$$-15<100\times(S_1-S_0)/S_0<15 \quad \text{requirement (1)}$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of a reciprocal of exposure giving a density of 2.5 obtained when the photothermographic material is exposed and heat-developed at 117° C. for 20 sec.

2. The photothermographic material of claim 1, wherein the photothermographic material comprises on the support component layers including an image forming layer, the image forming layer comprising the organic silver salt and the silver halide, and the image forming layer or a component layer adjacent to the image forming layer comprising the reducing agent.

3. The photothermographic material claim 2, wherein the image forming layer or the component layer adjacent to the image forming layer comprises a contrast-increasing agent.

4. The photothermographic material claim 1, wherein the photothermographic material exhibits an equilibrium moisture content of not more than 2% by weight.

5. The photothermographic material of claim 2, wherein the uppermost layer of the image forming layer-side comprises a binder, the binder exhibiting an equilibrium moisture content of not more than 2% by weight.

6. The photothermographic material of claim 2, wherein a surface of the image forming layer-side of the photothermographic material exhibits a Vickers hardness of 40 to 150.

7. The photothermographic material claim 1, wherein the reducing agent is incorporated in the form of a solid particle dispersion.

8. The photothermographic material of claim 1, wherein the photothermographic further comprises a tone modifier in the form of a solid particle dispersion.

9. The photothermographic material of claim 1, wherein the silver halide is monodisperse grains.

10. The photothermographic material of claim 1, wherein the organic silver salt is monodisperse grains having an average size of not more than 2 $\mu$m.

11. A method for processing a photothermographic material comprising:

subjecting the photothermographic material to heat-development, wherein the photothermographic material is subjected to heat-development at a temperature of 105 to 1450° C.; and the photothermographic material comprises a support, silver halide, an organic silver salt and a reducing agent, and meeting the following requirement (1):

$$-15<100\times(S_1-S_0)/S_0<15 \quad \text{requirement (1)}$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of reciprocal of exposure giving a density of 2.5 obtained when the photothermographic material is exposed and heat-developed at 117° C. for 20 sec.

12. An exposure method of a photothermographic material comprising:

exposing the photothermographic material to light, wherein the photothermographic material comprises a support, silver halide, an organic silver salt and a reducing agent, and meeting the following requirement (1):

$$-15<100\times(S_1-S_0)/S_0<15 \quad \text{requirement (1)}$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of reciprocal of exposure giving a density of 2.5 obtained when the photothermographic material is exposed and heat-developed at 117° C. for 20 sec.

13. The exposure method of claim 12, wherein the photothermographic material is exposed to longitudinally multiple laser light.

14. The exposure method of claim 12, wherein the photothermographic material is exposed to a laser light, the laser light and the exposed surface of the photothermographic material being not substantially at right angles to each other.

15. A photothermographic material comprising a support, silver halide, an organic silver salt and a reducing agent, wherein the photothermographic material exhibits an equilibrium moisture content of not more than 2% by weight and meets the following requirement (1):

$$-15<100\times(S_1-S_0)/S_0<15 \quad \text{requirement (1)}$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of a reciprocal of exposure giving a density of 2.5 obtained when the photothermographic material is exposed and heat-developed at 117° C for 20 sec.

16. A method for processing a photothermographic material comprising:

subjecting the photothermographic material to heat-development, wherein the photothermographic material is subjected to heat-development at a temperature of 105 to 145° C.; and the photothermographic material comprises a support, silver halide, an organic silver salt and a reducing agent, the photographic material exhibiting an equilibrium moisture content of not more than 2% and meeting the following requirement (1):

$$-15<100\times(S_1-S_0)/S_0<15 \quad \text{requirement (1)}$$

wherein $S_0$ represents a sensitivity of the photothermographic material heat-developed after being allowed to stand at 23° C. and 50% RH for a period of 3 days and $S_1$ represents a sensitivity of the photothermographic material heat-developed after being allowed to stand at 55° C. and 80% RH for a period of 3 days, provided that the sensitivity is represented by the logarithm of reciprocal of exposure giving a density of 2.5 obtained when the photothermographic material is exposed and heat-developed at 117° C. for 20 sec.

* * * * *